US006608983B2

(12) United States Patent
Terazawa et al.

(10) Patent No.: US 6,608,983 B2
(45) Date of Patent: Aug. 19, 2003

(54) TONER CONTAINER AND AIR STREAM DELIVERING MECHANISM

(75) Inventors: Seiji Terazawa, Shizuoka (JP); Tetsuya Kusano, Shizuoka (JP); Satoshi Muramatsu, Kanagawa (JP); Nobuo Kasahara, Kanagawa (JP); Fumio Ogata, Shizuoka (JP); Takeshi Tamaru, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/907,326

(22) Filed: Jul. 17, 2001

(65) Prior Publication Data

US 2001/0041083 A1 Nov. 15, 2001

Related U.S. Application Data

(63) Continuation of application No. 09/465,674, filed on Dec. 17, 1999.

(30) Foreign Application Priority Data

Dec. 22, 1998 (JP) ..... 10-365108
Mar. 24, 1999 (JP) ..... 11-80577
Apr. 15, 1999 (JP) ..... 11-108464

(51) Int. Cl.[7] ..... G03G 15/08
(52) U.S. Cl. ..... 399/258; 399/106; 399/262
(58) Field of Search ..... 399/106, 92, 258, 399/262; 222/82, 92, 325, 402.1, 402.25, DIG. 1; 114/114

(56) References Cited

U.S. PATENT DOCUMENTS 4,274,455 A 6/1981 Simons
4,945,956 A 8/1990 Bueyuekgueclue et al.
4,984,023 A * 1/1991 Yoshida ..... 399/106
5,074,342 A * 12/1991 Kraehn ..... 141/65
5,412,364 A * 5/1995 Iguchi et al. ..... 399/262
5,576,816 A * 11/1996 Staudt et al. ..... 222/DIG. 1
5,595,223 A * 1/1997 Hayao ..... 141/18
5,655,195 A 8/1997 Ichikawa et al.
5,740,507 A 4/1998 Ichikawa et al.
5,915,154 A * 6/1999 Schoch et al. ..... 399/258
5,950,055 A * 9/1999 Yahata et al. ..... 399/252
5,979,326 A * 11/1999 Ohinata ..... 101/494
6,201,941 B1 * 3/2001 Kasahara et al. ..... 399/258

FOREIGN PATENT DOCUMENTS

JP 60-232578 * 11/1985
JP 03-241372 * 10/1991
JP 6208301 7/1994
JP 7-20705 1/1995
JP 7261529 10/1995
JP 7281519 10/1995
JP 08-171281 * 7/1996
JP 08-171331 * 7/1996
JP 8334968 12/1996

* cited by examiner

*Primary Examiner*—Robert Beatty
(74) *Attorney, Agent, or Firm*—Cooper & Dunham, LLP.

(57) ABSTRACT

In an image forming apparatus, atoner container removably set on the apparatus and a developing section included in the apparatus are communicated to each other by a delivery passage. Toner can be delivered from the toner container to the developing section via the delivery passage by a stream of air even when the container and developing section are located at remote positions.

50 Claims, 30 Drawing Sheets

TONER CONTAINER AND AIR STREAM DELIVERING MECHANISM

This is a continuation of application Ser. No. 09/465,674 filed Dec. 17, 1999.

BACKGROUND OF THE INVENTION

The present invent ion relates to a toner container and a method and an apparatus for forming an image by using the same.

An electrophotographic image forming apparatus of the type developing a latent image formed on an image carrier with toner stored in a developing unit is conventional. This type of image forming apparatus is implemented as, e.g., a copier, a printer, a facsimile apparatus or a combination thereof. Fresh toner is replenished form the toner container to the developing unit for development.

Usually, the toner container is removably mounted to the body or the developing unit of the image forming apparatus and replaced when it runs out of toner. After the toner container has been packed with toner, it is put on the market as a product independent of the apparatus body.

Japanese Patent Laid-Open Publication No. 7-20705, for example, discloses a toner container formed with a spiral groove in its inner periphery toward a toner outlet or mouth. When the toner container is rotated about its axis, toner is fed out via the spiral groove. This toner container is formed of, e.g., plastics. On the other hand, Japanese Patent Laid-Open Publication No. 7-281519 teaches a toner container having thereinside an agitator for delivering toner and formed with plastics or paper. The agitator is rotated to feed out toner while agitating it. The toner containers taught in the above documents both are hard toner containers each having a toner discharging mechanism thereinside.

Toner driven out of any one of the above toner containers by the toner discharging mechanism directly drops into a hopper included in the developing unit. The toner is conveyed from the hopper to a developing position for developing a latent image formed on an image carrier. It is therefore necessary to locate the toner container in the vicinity of the developing unit in the image forming apparatus. In addition, considering the drop of the toner, it is necessary to locate the toner container above the developing unit unless some special mechanism is used. To meet these requirements, the toner container has customarily been considered to be integral with the developing unit and provided with an exclusive space in relation to the layout of various means and parts arranged in the image forming apparatus.

The prerequisite with the image forming apparatus is that the delivery of toner from the toner container to the developing unit be continuous and stable. However, the above conventional system for replenishing toner from the toner container to the developing unit cannot sufficiently meet this prerequisite, limiting image quality available with the apparatus. Another problem is that some of the toner stored in the toner container is left in the container without contributing to image formation and simply wasted.

Attention has not been paid to the above problems or solutions thereto in the past.

SUMMARY OF THE INVENTION

It is therefore an object of the present invention to provide a method and an apparatus for image formation using a new toner replenishing system making it needless to locate a toner container and a developing unit close to each other and thereby obviating limitations on layout, and a new toner container for the same.

It is another object of the present invention to provide a method and an apparatus for image formation using a new toner replenishing system allowing toner to be stably delivered to a developing unit at all times and noticeably reducing the amount of toner to be left at the end of delivery, and a new toner container for the same.

In accordance with the present invention, a toner container for an electrophotographic image forming apparatus includes a toner outlet for discharging toner, and a mating portion for allowing the toner outlet to mate with an elongate matter and remain in a mating position.

Also, in accordance with the present invention, in a method of packing toner in a toner container including a sack formed of a flexible material and a toner outlet and deformable in accordance with air pressure to thereby vary a capacity thereof, the toner container is packed with the toner with the sack reduced in capacity beforehand.

Further, in accordance with the present invention, an electrophotographic image forming method has the steps of setting a toner container packed with toner on an image forming apparatus including a developing section, setting up a toner delivery passage between the toner container and the developing section, and delivering the toner from the toner container to the developing section via the toner delivery path with an air stream.

Moreover, in accordance with the present invention, an electrophotographic image forming apparatus includes a developing section, and an elongate toner delivering device. The developing section and one end of the toner delivering device are connected to each other.

BRIEF DESCRIPTION OF THE DRAWINGS

The above and other objects, features and advantages of the present invention will become more apparent from the following detailed description taken with the accompanying drawings in which:

FIG. 3-1 and 3-2 are views showing a nozzle included in the illustrative embodiment;

FIGS. 5-1 and 5-2 are views each showing a particular modification of the nozzle;

FIGS. 10-1 through 10-3 are views showing specific configurations of a tight contact enhancing mechanism included in the illustrative embodiment;

FIGS. 11-1 through 11-3 are views showing another specific configurations of the tight contact enhancing mechanism;

FIGS. 12-1 and 12-2 are views showing sill another specific configuration of the tight contact enhancing mechanism;

FIGS. 13-1 and 13-2 are views showing a further specific configuration of the tight contact enhancing mechanism;

FIGS. 14-1 through 14-3 are views showing a still further specific configuration of the tight contact enhancing mechanism;

FIGS. 15-1 and 15-2 are views showing the external appearance of the toner container;

FIGS. 16-1 through 16-3 are views showing specific configurations of a mouth forming part of the toner container;

FIGS. 19-1 and 19-2 are views showing a modification of the toner container;

FIGS. 21-1 through 21-3 are views each showing a particular modification of the toner container;

FIGS. 25-1 and 25-2 are views showing a further modification of the toner container;

DESCRIPTION OF THE PREFERRED EMBODIMENTS

Figure 1:
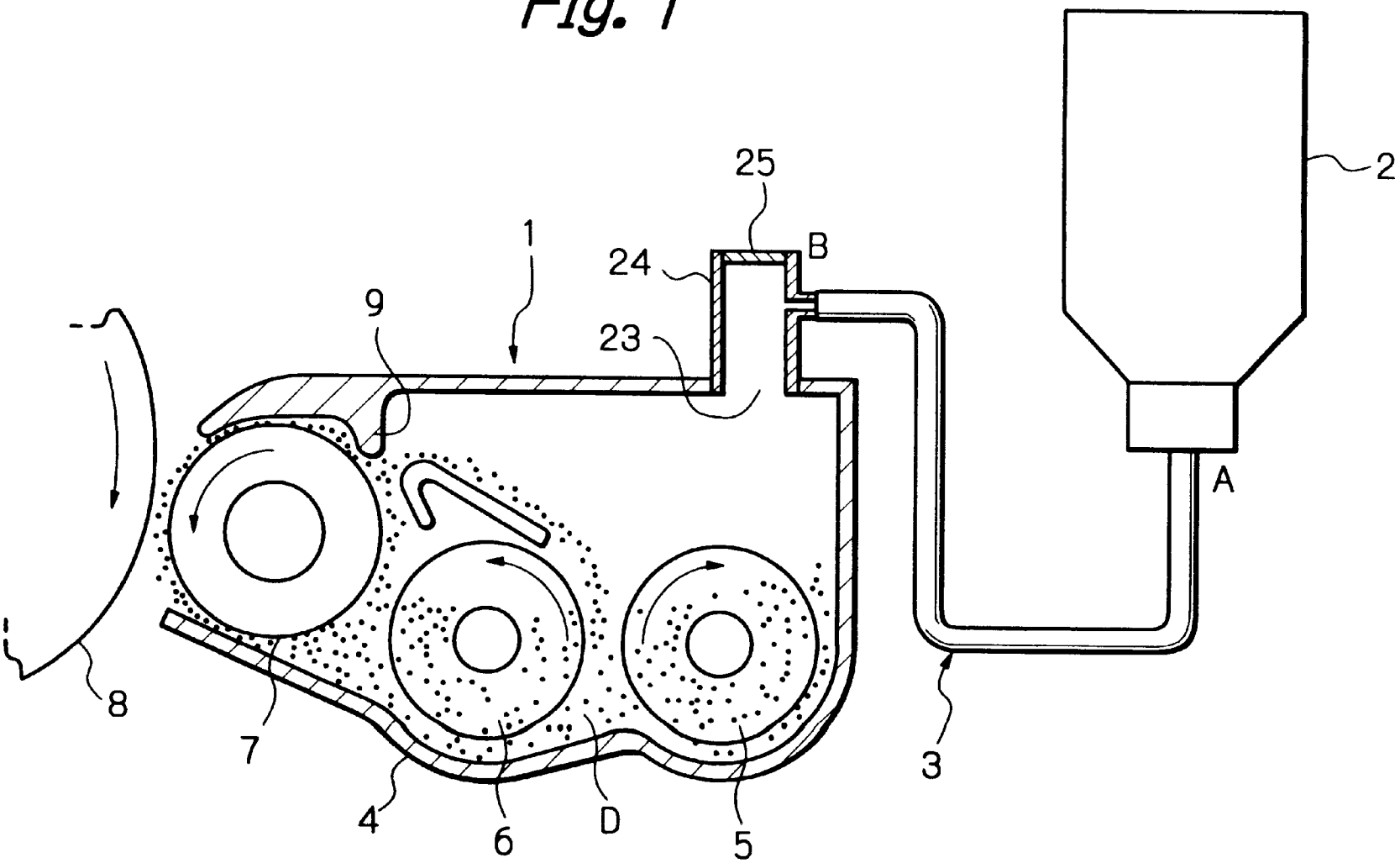
FIG. 1 is a view showing a toner replenishing system embodying the present invention and including a developing section, a toner container for replenishing toner to the developing section, and toner delivering means connecting the developing section and toner container.

Referring to FIG. 1 of the drawings, a toner replenishing system embodying the present invention is shown and includes a developing section 1 arranged in the body of an image forming apparatus. A toner container 2 is communicated to the developing section 1 by toner delivering means 3 and stores toner to be replenished to the developing section 1. The developing section 1 includes a casing 4 storing a two-ingredient type developer D, i.e., a toner and carrier mixture. A first and a second screw or agitator 5 and 6, respectively, and a developing roller 7 are disposed in the casing 4. The developing roller 7 faces a photoconductive drum or image carrier 8. A latent image is electrostatically formed on the drum 8 while the drum 8 is rotated in a direction indicated by an arrow in FIG. 1.

The two screws 5 and 6 each are rotated in a particular direction indicated by an arrow in FIG. 1, agitating the developer D and thereby charging the toner and carrier to opposite polarities. The charged developer D is deposited on the surface of the developing roller 7 being rotated in a direction indicated by an arrow in FIG. 1. The developing roller 7 conveys the developer D to a developing position where the drum 8 and roller 7 face each other. At this instant, a doctor blade 9 regulates the amount of the developer D being conveyed toward the developing position. At the developing position, the toner of the developer D is electrostatically transferred from the developing roller 7 to the latent image formed on the drum 8, thereby producing a corresponding toner image.

Assume that a toner content sensor, not shown, determines that the toner content of the developer D existing in the casing 4 is short. Then, fresh toner is replenished from the toner container 2 to the casing 4 in order to maintain the above toner content constant. The toner container 2 is removably mounted to the apparatus body.

In the illustrative embodiment, the toner is replenished from the toner container 2 to the developing section 1 by a stream of air generated in the toner delivering means or delivery passage 3. With this configuration, it is possible to effect replenishment even when the toner container 2 and developing section 1 are located at remote positions. The prerequisite with this system is that the delivery passage 3 be closed as hermetically as possible. This condition, i.e., substantially hermetically closed condition refers to a condition wherein substantially no toner leaks from the delivery passage 3.

The delivery passage 3 is formed by connecting the toner container 2 and developing section 1 by long toner delivering means. The above hermetically closed condition is maintained throughout the delivery passage 3 between the position where one end of the toner delivering means is connected to the outlet of the toner container 2 and the position where the other end of the toner delivering means is connected to the developing section 1. To guarantee the hermetically closed condition, it is necessary to give consideration to the connection of parts connected to each other. Particularly, it is essential that one end of the toner delivering means and the outlet of the toner container 2 be connected together as tightly as possible. The present invention successfully enhances the airtight connection between the above end of the toner delivering means and the outlet of the toner container 2, as will be described specifically later.

The toner delivering means includes means for generating an air stream (air stream generating means hereinafter) and an elongate conduit. While the entire toner delivering means is described as being elongate because of the elongate conduit, the length of the toner delivering means is open to choice. Therefore, the toner delivering means generally refers to interconnected parts existing between the toner container 2 and the developing sect ion 1 for feeding the toner from the former to the latter and including the air stream generating means and conduit.

The air stream generating means includes an air pump or similar means for sending air into the toner container 2 (air sending means hereinafter) or a suction pump or similar means for sucking air out of the toner container 2 (air sucking means hereinafter). As the air stream generating means generates an air stream in the delivery passage 3 flowing toward the developing section 1, the toner is carried by the air stream to the developing section 1 via the passage 3 without staying in the passage 3. The operation of the air stream generating means is controllable to control the intensity of the air stream and therefore the amount of toner to be replenished.

The above toner replenishing system may be implemented as any one of a blow system which blows air into the toner container 2 for forcing the toner out of the container 2, a suction system which sucks air out of the container 2 together with toner, and a combined toner and suction system, as will be described specifically hereinafter. It is to be noted that the toner delivering means of the illustrative embodiment and parts constituting it are not limited by any one of the above systems.

First, the blow system will be described with reference to FIG. 2. As shown, the toner delivering means 3 is made up of an air pump or air sending means 10, a nozzle 11, a toner conduit 12, and an air conduit 14. The toner conduit 12 and air conduit 14 connect the toner container 2, air pump 10, nozzle 11, and developing section 1. While the toner conduit 12 and air conduit 14 each may have any suitable dimensions and formed of any suitable material, they should preferably be flexible to allow the toner container 2, air pump 10 and developing section 1 to be located at desired positions and connected in any desired direction. A flexible tube may advantageously be provided with a diameter of 4 mm to 10 mm and formed of polyurethane, nitrile rubber, EPDM (Ethylene-Propylene-Diene Terpolymer), silicone or similar rubber resistant to toner.

Figure 2:
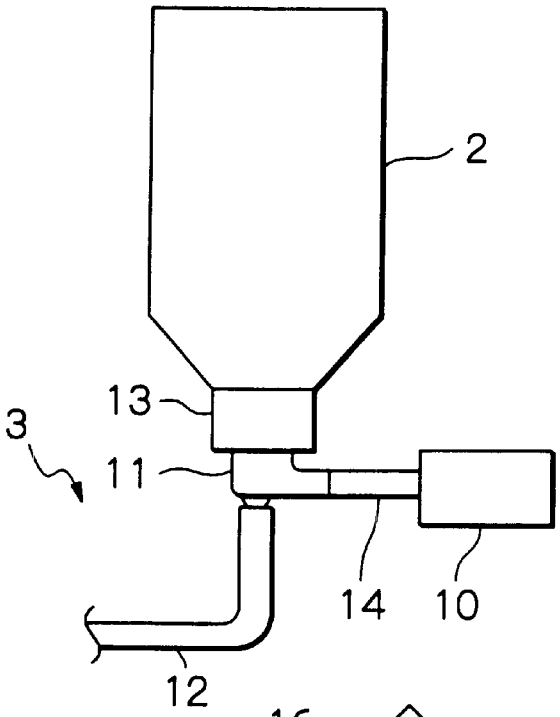
FIG. 2 is a view showing the toner container and toner delivering means more specifically.
Figures 1, 3:
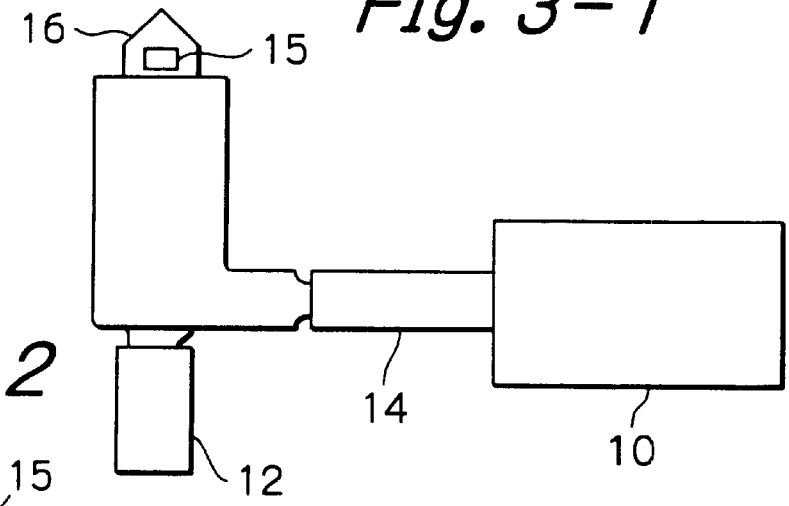
Figures 2, 3:
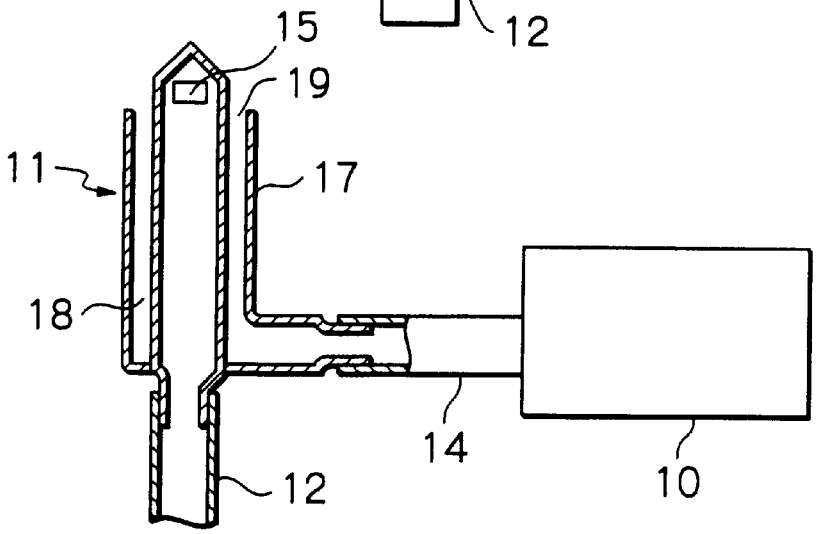

FIGS. 3-1 and 3-2 show a specific configuration of the nozzle 11. As shown, the nozzle 11 is a columnar member formed of, e.g., plastics or metal. The nozzle 11 has a tubular toner outlet portion 16 and a tubular air inlet portion 16 extending in the lengthwise direction of the column and each protruding from the opposite ends or the side of the column, as illustrated. A hole or toner outlet 15 is formed in one end of the toner outlet portion 16. The air inlet portion 18 surrounds the toner outlet portion 16. The nozzle 11 has its outermost wall 17 connected to the toner outlet portion or mouth of the toner container 2, not shown, such that the hole 15 is disposed in the container 2, as will be described more specifically later.

The other end of the toner outlet portion 16 remote from the hole 15 is connected to one end of the toner conduit 12. As shown in FIG. 1, the other end of the toner conduit 12 is connected to a connecting member 24 affixed to a toner inlet 23 included in the developing section 1. The connecting member 24 includes a filter 25 that passes air therethrough, but stops the toner. The end of the air inlet portion 18 protruding from the side of the nozzle 11 is connected to one end of the air conduit 14. The other end of the air conduit 14 is connected to the delivery port of the air pump mounted on the apparatus body.

As stated above, the nozzle 11 is connected to a toner outlet portion or mouth 13 (see FIG. 2) included in the toner container 2 while the toner outlet portion 16 is connected to the connecting member 24 by the toner conduit 12, completing the delivery passage.

Figure 4:
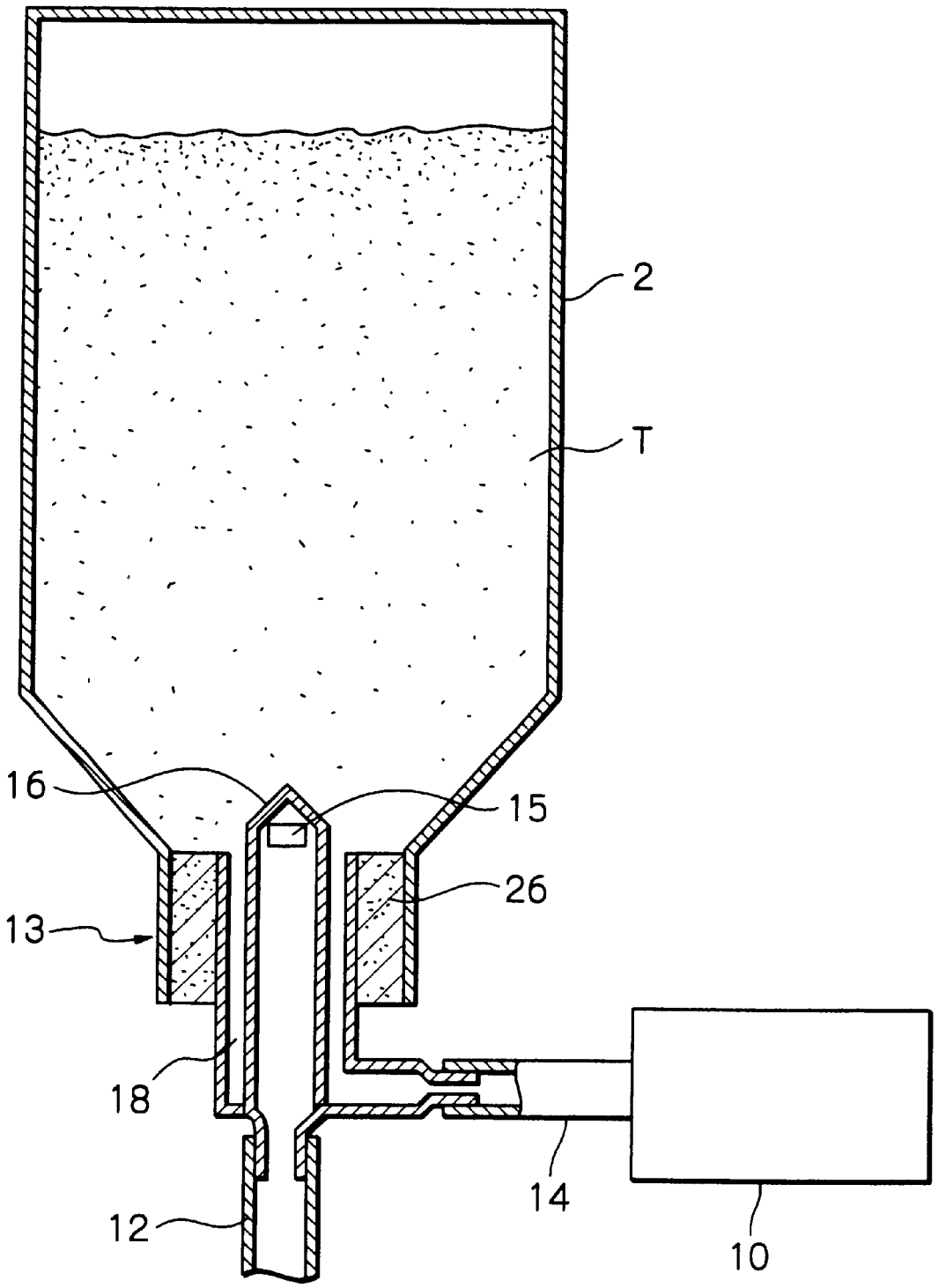
FIG. 4 is a view showing the toner container and nozzle connected to each other.

FIG. 4 shows a specific configuration for connecting the toner container 2 to the nozzle 11. The toner container 2, which is a specific form of a toner container applicable to the present invention, will be described in detail later. As shown, a mechanism 26 for enhancing tight contact (tight contact enhancing mechanism hereinafter) is arranged in the tubular mouth 13 of the toner container 2. While the toner container 2 is positioned upright with the mouth 13 facing downward, one end or tip of the nozzle 11 is inserted in the tight contact enhancing mechanism 26. The mechanism 26 is implemented by a flat elastic member 20 (see FIGS. 10-1 and 10-2) affixed to the inner periphery of the mouth 13 and great enough to fill up the space inside the mouth 13. The elastic member 20 is formed with slits that will be described later. The elastic member 20 prevents the toner from leaking from the toner container 2 despite the slits. In addition, when the tip of the nozzle 11 is inserted into the toner container 2, the member 20 deforms to insure air-tightness without any gap intervening between the member 20 and the nozzle 11. This is successful to insure toner delivery using the air stream.

When air is sent into the air container 2, it fluidizes the toner, labeled T, existing in the container 2, and in addition raises pressure in the container 2. As a result, the fluidized toner T is forced out of the toner container 2 via the hole 15 of the toner outlet portion 16. The toner T is carried by the air stream to the connecting member 24, FIG. 1, via the toner outlet portion 16 and toner conduit 12 and then introduced into the casing 4 via the toner inlet 23. At this instant, only air flows out via the filter 25. The air pump 10 stops operating on the elapse of a preselected period of time. Such a procedure is effected every time the toner content of the developer D existing in the developing section 1 becomes short, thereby confining the toner content in a preselected range.

Figures 2, 5:
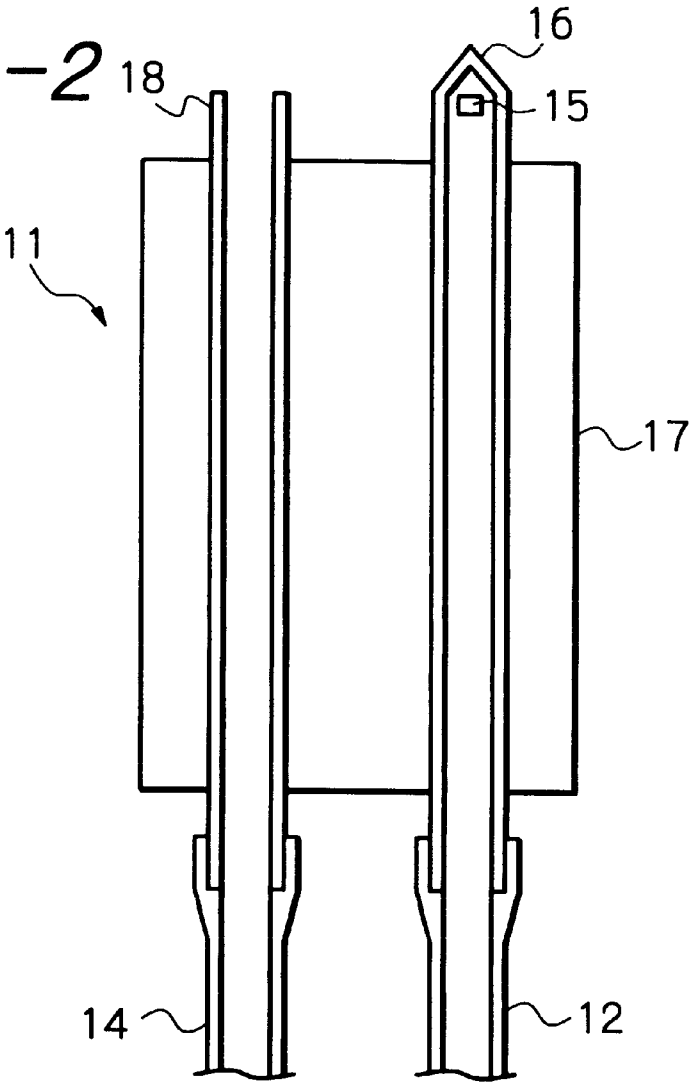
Figures 1, 5:
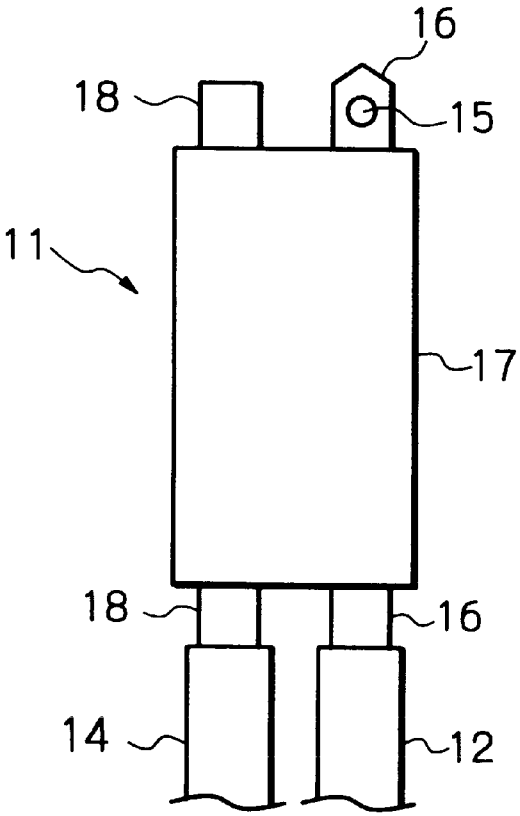

FIGS. 5-1 and 5-2 show a modification of the nozzle of FIGS. 3-1 and 3-2; identical structural elements are designated by identical reference numerals. As shown, the modified nozzle 11 has the tubular toner outlet portion 16 and tubular air inlet portion 18 separate from and parallel to each other. The inside of the nozzle 11 supporting the two portions 16 and 18 may be hollow or solid, as desired.

In another specific blow system, not shown, the toner container itself is formed with two holes, one for toner delivery and the other for air feed. A tubular structural body positioned in one hole for toner delivery is directly connected to the toner conduit 12 while the other hole is connected to an air pump via an air conduit. Air is sent into the toner container via the air feed hole by an air pump, so that toner is delivered to the developing section via the toner outlet hole.

Figure 6:
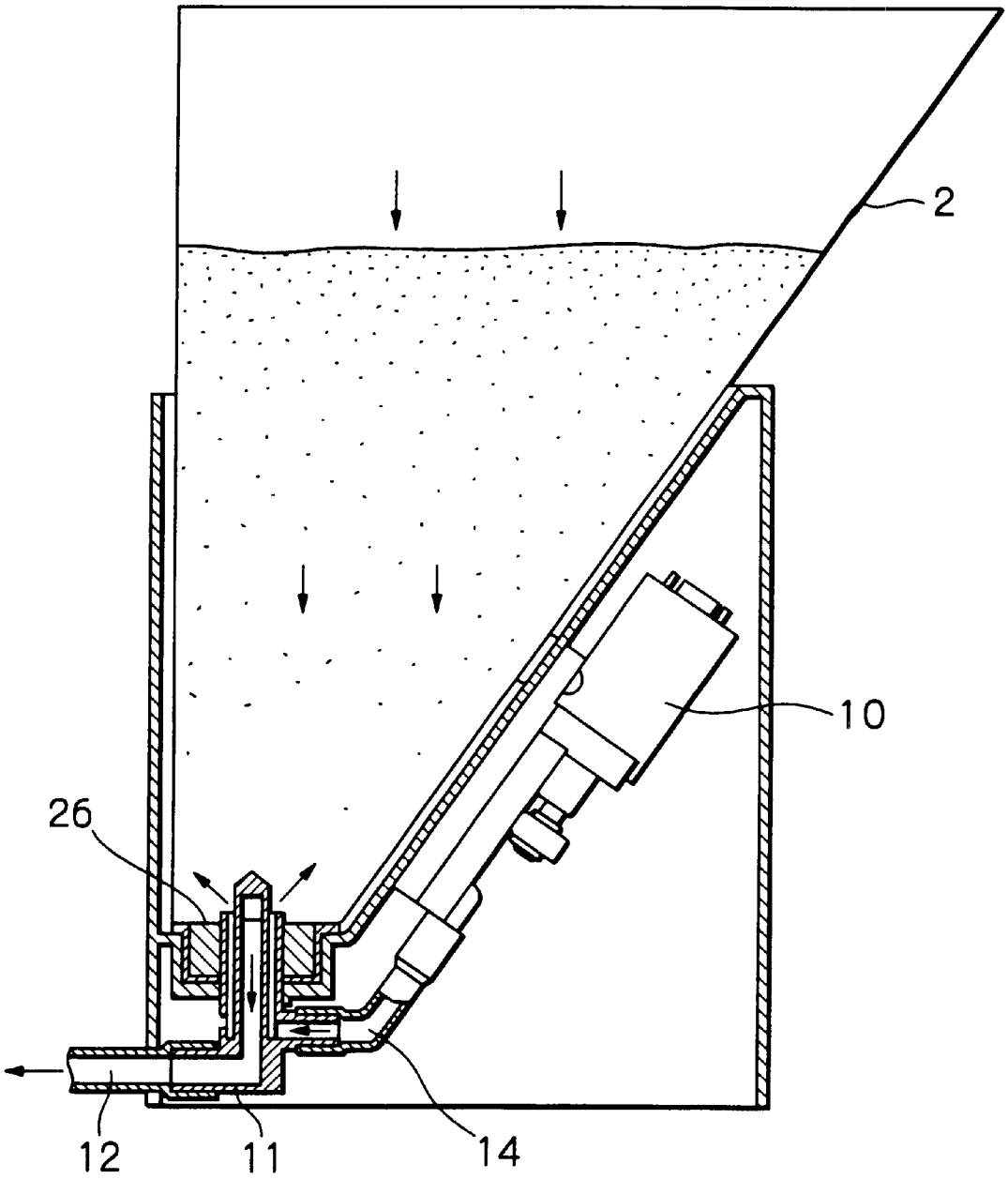
FIG. 6 is a section the toner container and nozzle.

FIG. 6 shows another specific blow system applicable to the illustrative embodiment.

The blow system described above is capable of loosening and fluidizing the toner that may cohere in the toner container 2. The blow system is therefore particularly effective to stabilize the delivery of the toner.

Figure 7:
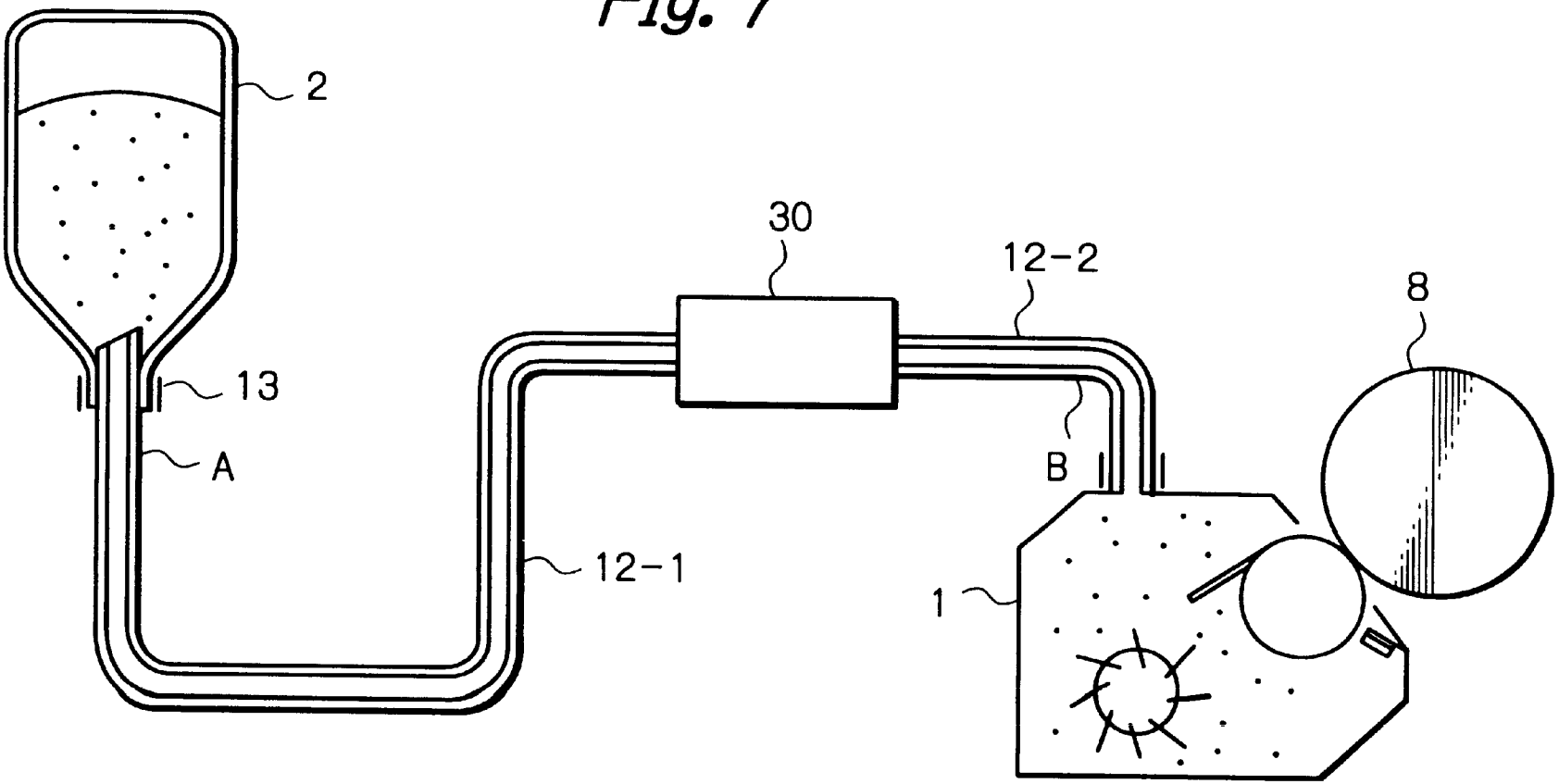
FIG. 7 is a view showing a specific configuration of the toner replenishing system including a suction pump.

Reference will be made to FIG. 7 for describing the suction system in which the air sucking means is implemented by a suction pump. As shown, a suction pump 30 intervenes between the toner container 2 and the developing section 1, i.e., it is connected to the toner container 2 and developing section 1 by toner conduits 12-1 and 12-2, respectively. The suction pump 30 sucks the toner out of the toner container 2 and delivers it to the developing section 1 together with air. As for the rest of the construction, the suction system is similar to the blow system.

Figure 8:
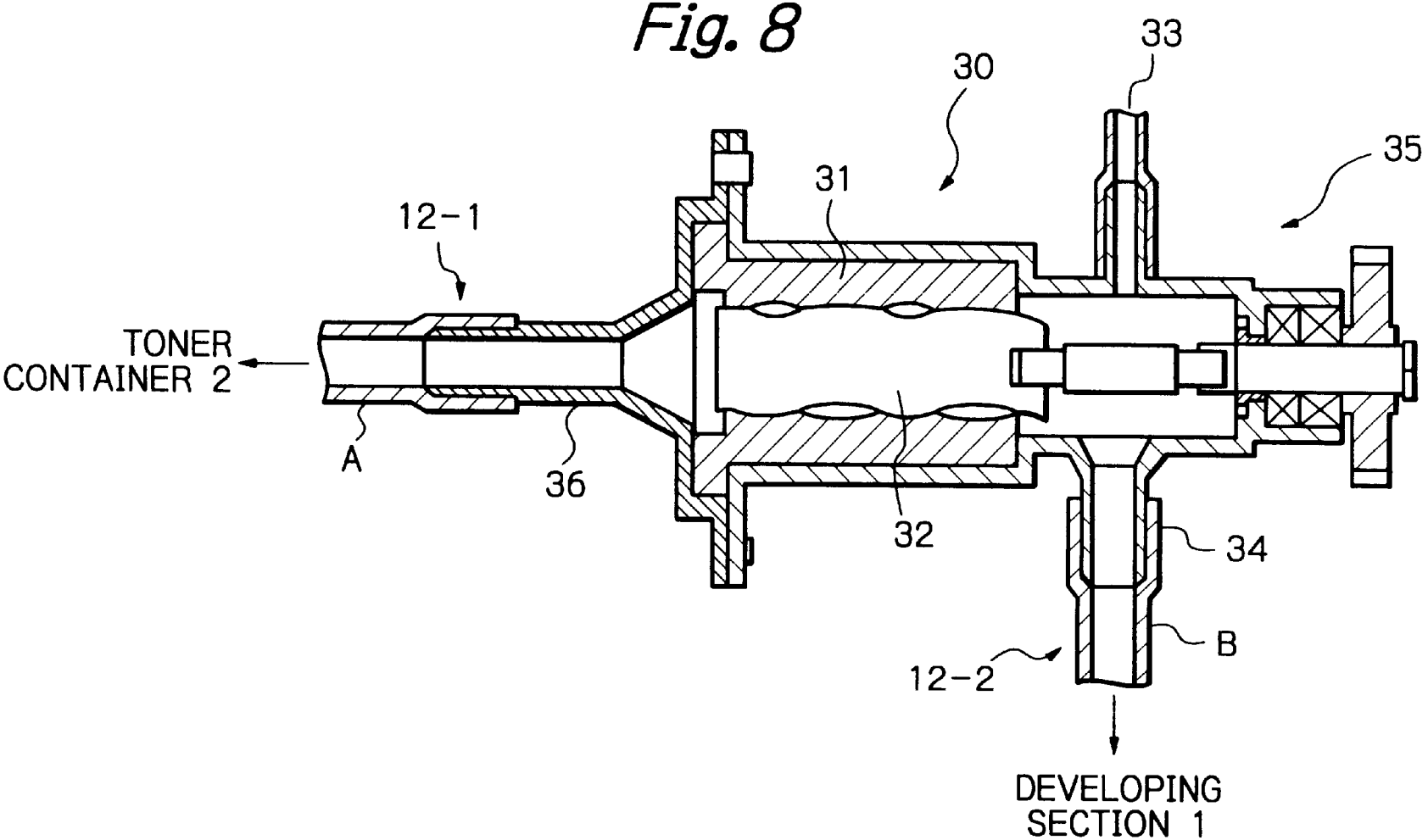
FIG. 8 is a section showing the suction pump.

FIG. 8 shows a specific configuration of the suction pump 30 that is generally referred to as a Mono pump. As shown, the pump 30 includes a pump body 30 having a casing 31 and a twisted rotary shaft 32 disposed in the casing 31. A shallow spiral groove is formed in the inner periphery of the casing 31. A delivery section 35 is positioned at the outlet side of the pump body 30 and includes an air inlet tube 33 and a delivery tube 34. A toner suction tube 36 is positioned at the suction side of the pump body 30 and connected to the mouth 13 of the toner container 2 by the toner conduit 12-1. The delivery tube 34 is connected to the developing section 1 by the other toner conduit 12-2. If desired, the pump body 30 and developing section 1 may be directly connected to each other without the intermediary of the toner conduit 12-2. Particularly, the pump 30 can sufficiently function even when it is located at a remote position from the toner container 2.

In the above suction system, the toner conduits 12-1 and 12-2 and suction pump 30 constitute the toner delivering means. Also, the toner conduit 12-1, the suction tube 36 and delivery tube 34 of the pump 30 and the toner conduit 12-2 form the delivery passage. This delivery passage should preferably be closed as hermetically as possible. This is particularly true with the position where the mouth 13 of the toner container 2 and the toner conduit 12-1 are connected.

In operation, while air under preselected pressure is fed into the delivery section 35 of the pump 30, the shaft 32 of the pump body 30 is rotated. The shaft 32 moving in the space between it and the casing 31 sucks the toner out of the toner container 2 and conveys it to the delivery section 35 without compressing it. Air fed into the delivery section 35 via the air inlet tube 33 scatters and fluidizes the toner and conveys it to the developing section 2 via the delivery tube 34 and toner conduit 12-2.

The suction system allows the delivery of the toner to be controlled in terms of the rotation speed and rotation time of the pump 30 and therefore promotes accurate toner replenishment.

A specific form of the toner container in accordance with the present invention is implemented by a flexible sack and a mouth or toner outlet portion affixed thereto. The sack is deformable due to air pressure in such a manner as to reduce its volume. When the above suction system is applied to this kind of toner container, it is likely that portions of the inner periphery of the flexible sack facing each other closely contact and obstruct the delivery of the toner. However, a series of experiments showed that the flexible sack is free from such a problem. Specifically, when the air sucking means starts operating, it first sucks the center portion of the container and forces the toner out of the center portion. At the same time, the toner gathers on the inner periphery of the container while forming a space at the center. As the suction is continued, the wall of the container sequentially deforms in the form of jags, causing the toner to drop from the inner periphery to the center space. This is repeated to deliver the entire toner from the toner container.

Figure 9:
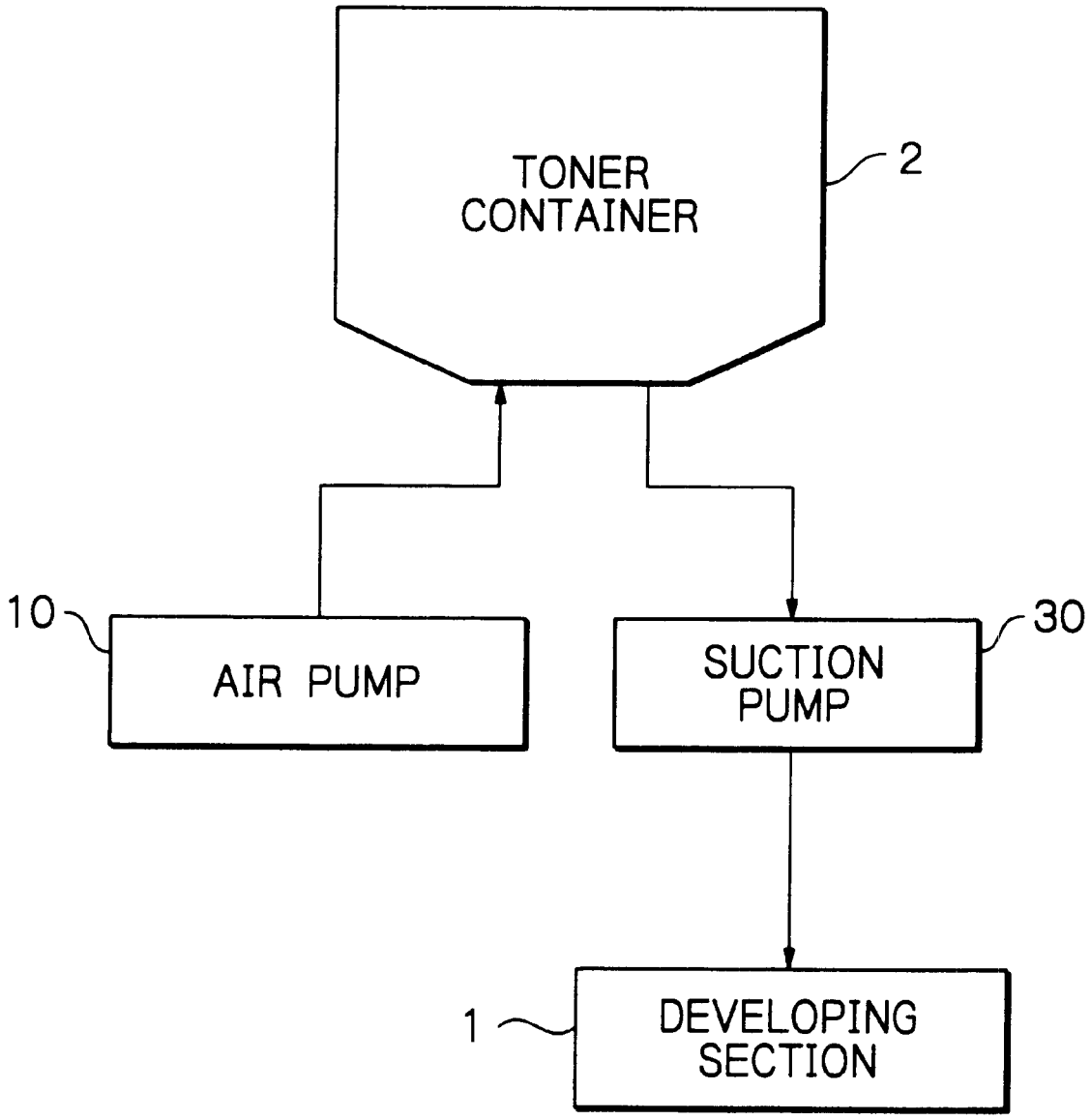
FIG. 9 is a view showing another specific configuration of the toner replenishing system implemented by a combined blow and suction system.

The combined blow and suction system will be described with reference to FIG. 9. As shown, the suction pump 30 having the construction of FIG. 8 by way of example is positioned between the toner conduit 12 and the developing section 1 of the blow system. As for the toner delivering means, the combined system is identical with the blow system except for the addition of the suction pump.

In the combined system, when the suction pump 30 is operated, it sucks the toner via the hole 15 of the toner outlet portion 16 of the nozzle 11. At the same time, the air pump 10 is operated to send a air into the toner container 2 via an air outlet 19. Even when the toner stays in the vicinity of the hole 15 in the form of a mass, air sent into the toner container 2 loosens it and prevents it from stopping the hole 15. Even cohered part of the toner is loosened and separates into particles. The suction pump 30 sucks such toner and delivers it to the developing section 1 via the toner conduit 12.

In the above combined system, the air pump 10, suction pump 30, nozzle 1, toner conduit 12 and air conduit 14 constitute the toner delivering means. Specifically, the wall 17 of the nozzle 11 is received in the mouth 13 of the toner container 2 while the toner outlet portion 16, suction pump 30 and connecting member 24 are connected via the toner conduit 12. The combined system, like the blow system or the suction system, must have its toner passage configured as hermetically as possible. The combined system implements stable and accurate toner delivery.

The toner container in accordance with the present invention will be described in detail hereinafter. While the toner container to be described was devised in relation to the above toner replenishing system of the present invention, it is similarly applicable to any other toner replenishing system. Also, various technical schemes devised for the toner container itself and the toner container filled with toner are usable to achieve the object of the present invention at a higher level and can be used alone or in combination. While the toner container will be described as being used with its mouth facing downward, it can, of course, be mounted to an image forming apparatus in any other desired position.

The toner container of the present invention includes at least a toner storing portion and a mouth or toner outlet portion. The mouth includes a tubular portion capable of mating with an elongate matter. This kind of mouth is representative of the characteristic function of the previously described mouth connectable to one end of the toner delivering means. In this sense, the elongate matter should only be a relatively thin columnar or tubular matter and is not limited to the toner delivering means of the toner replenishing system described above.

The toner container with such a mouth may be implemented as a hard toner container entirely formed of a hard material or as a soft sack formed of a flexible material. As for a hard container, use may be made of polyethylene, polypropylene, polyethylene terephthalate or similar resin or thick paper.

The toner container of the present invention is characterized in that the container does not include a toner discharging mechanism because of the use of an air stream, in that the container, whether it be hard or soft, is connected to the nozzle or the toner outlet tube forming one end of the toner delivering means by mating in order to be applicable to the above toner replenishing system, and in that at least part of the mouth capable of mating with, e.g., the nozzle is provided with the previously described characteristic function.

Because the toner replenishing system uses an air stream, the toner container does not include a toner discharging mechanism and does not have to be hard. This is why the toner container of the present invention can be soft. The mating portion of the mouth is implemented by a relatively rigid tubular body that may be a simple tubular body or a tubular body processed to enhance the function of maintaining the mated condition. Processing may be effected on a tubular body itself or by use of another material. A simple tubular member not processed is so configured as to make surface-to-surface contact with, e.g., the nozzle or formed of a material and sized to implement such contact. This is successful to stably hold the tubular body and nozzle in engagement as tightly as possible. The tubular body should preferably be cylindrical from the standpoint of manual mating.

When the tubular body is hard, it is usually molded integrally with a toner storing portion. However, the hard toner container of the present invention may even be one having a toner storing portion and a mouth prepared separately and removably connected together and/or having a toner storing portion implemented by at least two separable parts prepared separately. In such a case, it is preferable to implement the hermetically closed condition by, e.g., threaded engagement or insertion. The soft toner container will be described specifically later.

Two different systems are available for mating the above tubular body and, e.g., the nozzle, i.e., a system A which inserts the nozzle into the tubular body and a system B which inserts the tubular body into the toner conduit or the nozzle having a tubular structure.

It is essential with the toner replenishing system of the present invention that the delivery passage be closed as hermetically as possible, as stated earlier. This is particularly true with the connection of the mating portion of the tubular body and, e.g., the nozzle because the leak of air at the position where they are connected obstructs stable toner discharge and thereby increases the amount of residual toner to be left in the container and because the toner contaminates the inside of the apparatus. In accordance with the present invention, the mating portion is provided with a mechanism for maintaining the engaged condition of the tubular body and, e.g., the nozzle and further enhancing the tight contact thereof. This implements the processed tubular body as distinguished from a simple tubular body. This mechanism is similarly applicable to the connection of the other parts included in the delivery path. As for the system A, the tight contact enhancing mechanism is disposed in the tubular body or on the outer periphery of, e.g., the nozzle. As for the system B, the mechanism is provided on the outer periphery of the tubular body or, when the nozzle, for example, is the toner conduit, in the conduit; if desired, the mechanism may be arranged in the nozzle provided with a tubular structure.

The tight contact enhancing mechanism will be described more specifically on the assumption that it is arranged in the tubular body.

The elastic member disposed in the tubular body as the above mechanism has been described with reference to FIG. 4. The elastic member should preferably be formed of an elastic and flexible, but not air-permeable, material because an air-permeable material is liable to cause the toner to leak. For example, use may be made of foam polyurethane or similar sponge, rubber or felt. As for sponge, a material not air-permeable and having high density is preferable in order to increase the contact area of the elastic member with, e.g., the nozzle.

In FIG. 4, the flat elastic member formed with slits and sized to cover the opening of the tubular body is fitted in the tubular body. In this case, the elastic member should preferably be adhered to the inner periphery of the tubular body. When use is made of highly flexible sponge which is apt to make the insertion of, e.g., the nozzle difficult, it is desirable to adhere a film as thin as about 0.1 mm or less to the surface of the elastic member in order to increase rigidity.

Before the toner container 2 shown in FIG. 4 is mated with, e.g., the nozzle, the tight contact enhancing mechanism also serves to seal the container 2 for preventing the toner from leaking. Even when the nozzle, for example, is inserted into the sits of the elastic member 26, the member 26 insures tight contact without any gap occurring between the slit and, e.g., the nozzle.

Figures 1, 10:
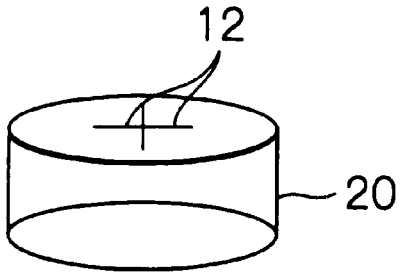
Figures 2, 10:
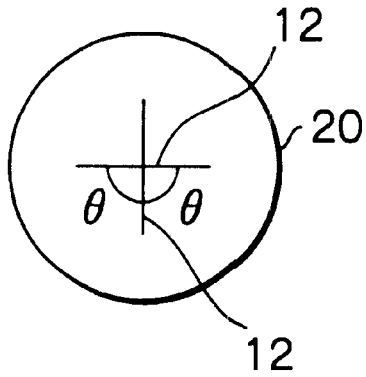
Figures 3, 10:
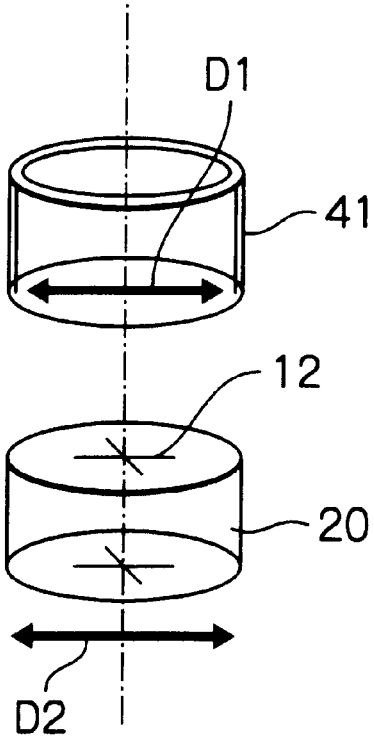

Referring to FIGS. 10-1 and 10-2, the elastic member 20 formed with two slits 12 intersecting each other covers the opening of the tubular body, constituting the tight contact enhancing mechanism. Preferably, the slits 12 should intersect each other at an angle θ of 90 degrees. In this condition, the elastic member 20 evenly presses the nozzle 11 over the entire circumference of the nozzle 11 and thereby guarantees tight contact. While the number of slits is open to choice, the slits should be spaced by the same angular distance as far as possible.

As shown in FIG. 10-3, an annular cover 41 having a suitable degree of rigidity may be fitted on the circumferential surface of the elastic member 20. The cover 41 is capable of accommodating the elastic member 20 and has a slightly smaller outside diameter than the elastic member 20. When the elastic member 20 is fitted in the cover 41, the latter presses the former radially inward and thereby further insures tight contact.

If desired, two elastic members which are air-permeable and not air-permeable, respectively, may be fitted in the tubular body with the air-permeable member facing the inside of the toner container. The prerequisite is that the slits of the two elastic members do not coincide with each other. Assume that the toner container is soft and emptied due to the consumption of the toner. Then, the volume of the toner container decreases and sends out the toner via the slits. However, the air-permeable elastic member catches such toner and noticeably reduces the scattering of the toner.

Figures 1, 11:
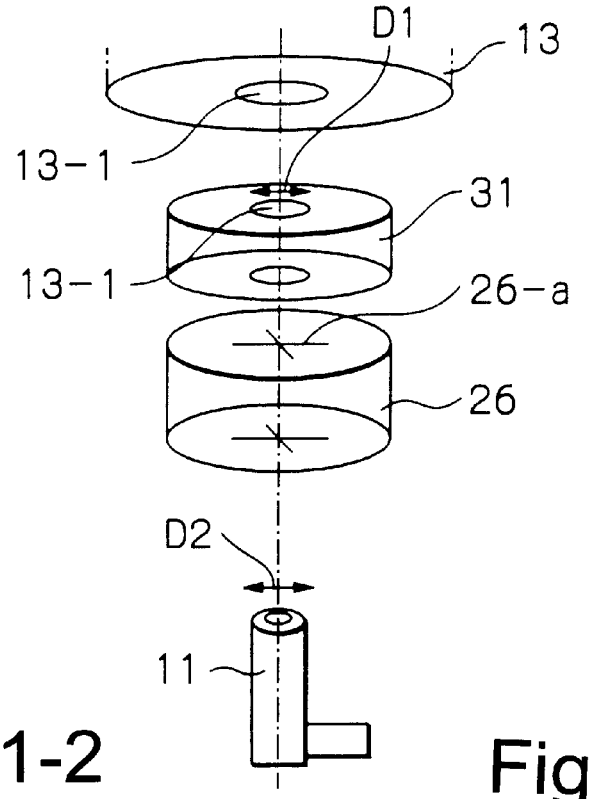
Figures 2, 11:
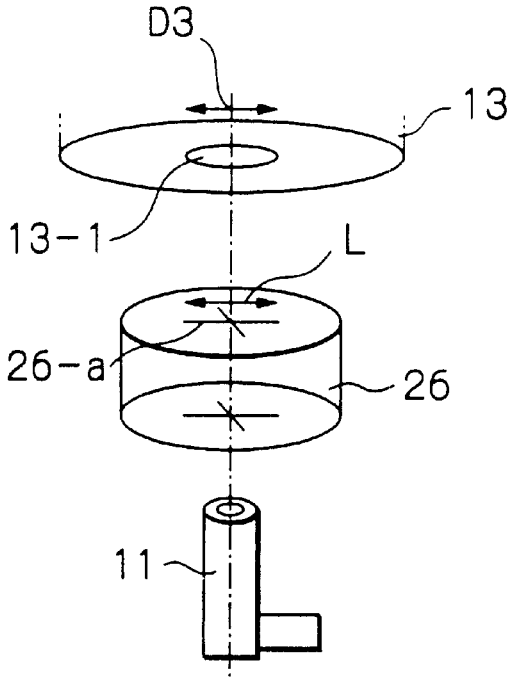
Figures 3, 11:
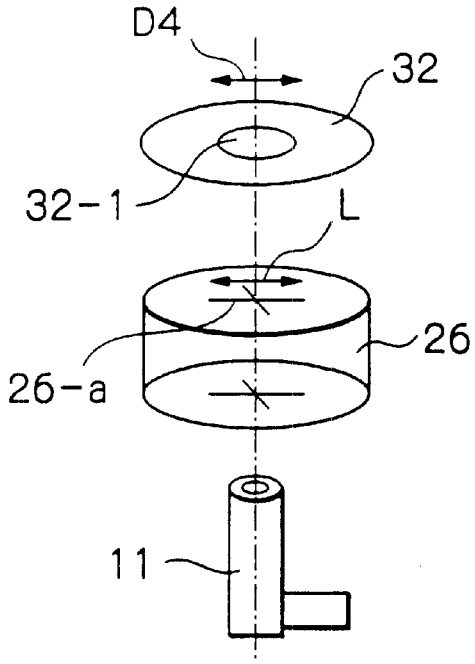

FIG. 11-1 shows another specific configuration using the elastic member. Tubular bodies shown in FIGS. 11-1 have a shoulder C (see FIG. 16-1) thereinside. The shoulder C forms a toner outlet 13-1. An annular elastic member 31 intervenes between the elastic member, labeled 26, and the toner outlet 13-1 and has a hole 31 extending in the direction in which the nozzle 11 is inserted into and removed from the tubular body. The hole 31-1 has a diameter D1 slightly smaller than the diameter D2 of the nozzle 11.

When the nozzle 11 is inserted into the toner container 2, it tightly contacts the annular elastic member 31 due to the above relation between the diameters D1 and D2. This, coupled with the elastic member 26, realizes a double air-tight structure. Further, when the nozzle 11 is removed from the toner container 2, the annular elastic member 31 removes the toner deposited on the nozzle 11, i.e., cleans the nozzle 11. The elastic member 26 also cleans the nozzle 11. As a result, contamination ascribable to the toner deposited on the nozzle 11 is obviated.

FIG. 11-2 shows another specific configuration in which the toner outlet 13-1 of the toner container 2 has a diameter D3 smaller than the length L of one slit 26-*a* of the elastic member 26. The elastic member 26 is formed with four slits, as illustrated. When the elastic member 26 is formed with three or more slits 26-*a,* the slits 26-*a* are apt to rise and stop, e.g., the hole of the nozzle 11 when the nozzle 11 is inserted into the toner container 2. The diameter D3 smaller than the length L solves this problem.

As shown in FIG. 11-3, to prevent the slits 26-*a* from rising, use may be made of a film 32 formed with a hole 32-1 having a diameter D4 smaller than the length L of one slit

26-*a*. The film 32 is fitted to the elastic member 26 with the center of its hole 32-1 aligning with the center of the toner outlet 13-1. This can be easily done by using a two-sided adhesive tape. The film 32 may be adhered to the entire surface of the elastic members 26 because the slits 26-*a* of the upper elastic member 26 and those of the lower elastic member 26 are not coincident except for their centers.

Figures 1, 12:
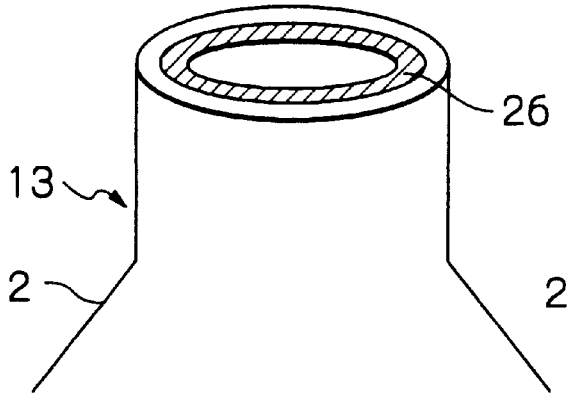
Figures 2, 12:
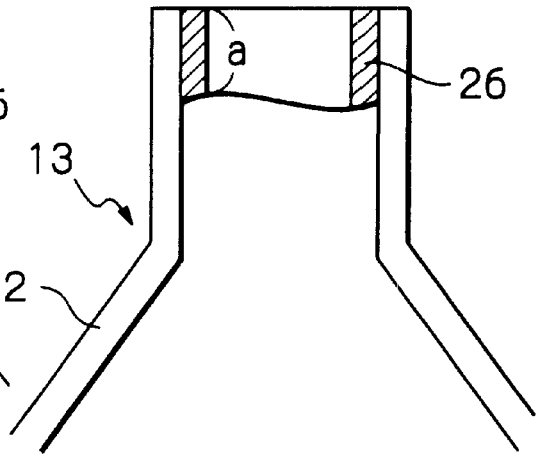
Figures 1, 13:
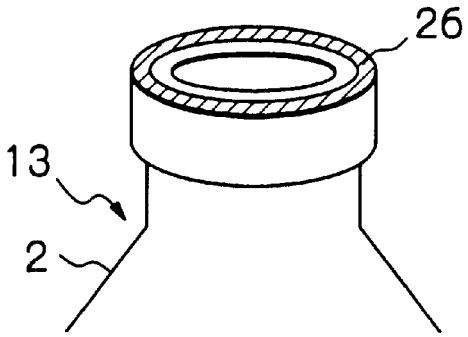
Figures 2, 13:
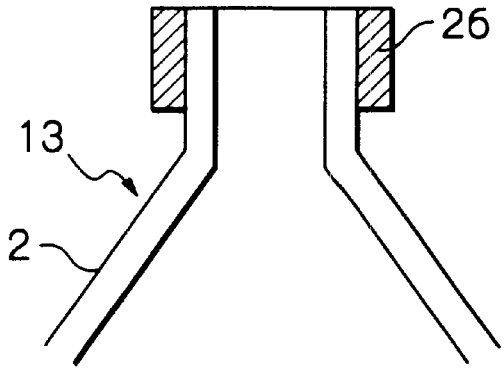

FIGS. 12-1 and 12-2 and FIGS. 13-1 and 13-2 each show another specific configuration of the tight contact enhancing mechanism. As shown, the elastic member 26 is implemented by a packing in the form of a plate or a sheet having any desired width a. The elastic member 26 is affixed to the inner periphery of the tubular body 13, as shown in FIGS. 12-1 and 12-2, or to the outer periphery of the same, as shown in FIGS. 13-1 and 13-2. If desired, a plurality of elastic members 26 may be fitted on the tubular body 13.

Figures 1, 2, 3, 14:
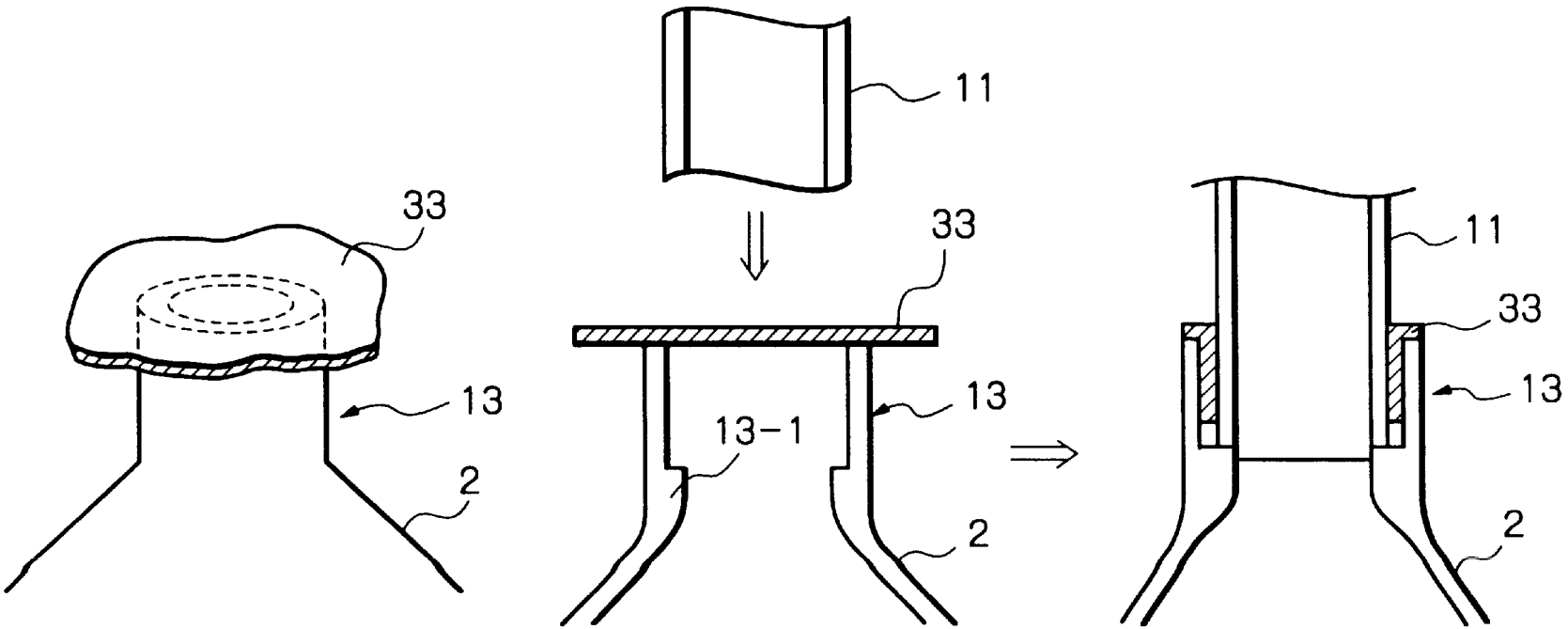

FIGS. 14-1 through 14-3 show another specific configuration of the tight contact enhancing mechanism. Usually, the toner outlet of the toner container 2 is sealed by some sealing means in order to prevent the toner from leaking. Specifically, in the configuration shown in FIG. 14-1, a sheet 33 is adhered to the toner outlet of the toner container 2. As shown in FIG. 14-2, the nozzle 11 is pressed against the sheet 33. As shown in FIG. 14-3, the nozzle 11 enters the toner container 11 by piercing the sheet 33. As a result, the sheet 33 is sandwiched between the tubular body 13 and the nozzle 11, enhancing tight contact.

The above sheet or seal 33 may be formed of rubber, aluminum or foam urethane by way of example. A recess may be formed at the center of the sheet 33 beforehand, so that the sheet 33 easily breaks when the nozzle 11 is inserted into the tubular body 13. It is essential with this scheme that the sheet 33 be firmly adhered to the outlet of the tubular body. The shoulder 13-1 may be formed in the tubular body 13 such that the tip of the nozzle 11 abuts against the shoulder 13-1. This will further promote tight contact.

The tight contact enhancing mechanism may be implemented by an undulation structure formed on the outer periphery of the tubular body, in which case the undulation structure will be received in the toner conduit. Further, a screw mechanism for connection may be provided on the tubular body and nozzle. The screw of the tubular body also allows a cap for sealing the opening of the tubular body to be fitted thereto. For this purpose, the cap should, of course, be provided with a screw mechanism.

The toner container of the present invention will be described more specifically with reference to FIGS. 15-1 and 15-2. As shown, the toner container 2 includes at least a mouth or toner outlet portion 50, a bottom 51, and a side wall 52 connecting the mouth 50 and bottom 51. The mouth 50 has a section 50-1 having a maximum diameter smaller than the maximum diameter of the bottom 51 although such a configuration is not limitative. Generally, therefore, the side wall 51 has a diameter sequentially decreasing at least in a portion 52-1 adjoining the mouth 50, as illustrated. The shape of the bottom 51 and the cubic shape of the toner container 2 are open to choice so long as they satisfy the above conditions.

The toner container of the present invention may be positioned vertically or horizontally, as desired, because of the toner replenishing system using an air stream. In practice, the vertical position of the container with its mouth facing downward is natural and most effective from the gravity standpoint. To stably discharge the toner with an air stream via the mouth facing downward and to minimize the amount of residual toner to be left in the container, it is effective to incline the smaller diameter portion 52-1 of the side wall 52 relative to the section 50-1 of the mouth or tubular portion 50. This is particularly desirable when the toner container is soft and easy to slacken. The angle θ between the smaller diameter portion 52-1 and the section 50-1 of the mouth 50 should preferably be, but not limited to, about 45 degrees to about 90 degrees, more preferably about 60 degrees to about 90 degrees. In FIG. 15-1, the angle θ of the smaller diameter portion 52-1 is the same at both sides. In FIG. 15-2, a smaller diameter portion 52-2 has an angle θ 1 of about 90 degrees at one side and an angle θ 2 smaller than 90 degrees at the other side. It is to be noted that such a smaller diameter portion does not have to be formed over the entire side wall 52.

The softer toner container available with the present invention includes at least a flexible sack or toner storing portion and a rigid mouth or toner outlet portion, as stated earlier. The sack is designated by the reference numeral 2*a* in FIGS. 16-1 and 16-3. It is to be noted that the soft toner container of the present invention may even be one whose sack is partly flexible and partly rigid. The mouth expected to mate with the mating portion having the previously stated function should preferably be formed of a relatively rigid material.

The soft toner container is deformable due to air pressure introduced thereinto, i.e., has its volume sequentially reduced by suction or sequentially increased by blow. As for the soft toner container, the cubic shape mentioned earlier refers to the shape of the container filled with air.

Advantages achievable with the soft toner container are as follows. Before the toner container is packed with toner, the sack of the container can be substantially evacuated, i.e., reduced in volume. This allows a minimum of air to exist between toner particles dropped from a hopper, not shown, and therefore causes the toner to rapidly sink in the toner container. As a result, the total packing time is reduced, and contamination ascribable to toner is minimized. The toner container is protected from damage ascribable to shocks and impacts during delivery to a user. In addition, the storage and transport of such a toner container does not need a shock absorbing material which would increase costs Further, after the soft toner container has been emptied and removed from the apparatus body, it can be folded up in an extremely compact configuration. The user can therefore easily handle the toner container and can even send it by mail for a recycling purpose. For a transportation company, the lightweight, folded toner container is easy to transport, flexible and therefore easy to handle, and is prevented from being scratched or otherwise damaged. This is successful to reduce the transportation cost of empty toner containers. A toner producing industry also achieves cost reduction because the toner container is reusable. In addition, we experimentally confirmed that the residual toner and other contaminants could be removed more easily from the flexible toner container than from the hard toner container.

The sack and mouth of the soft toner container should preferably be produced independently and then connected together from the production standpoint, as stated earlier.

The flexible sack may be formed of a sheet of polyester, polyethylene, polyurethane, polypropylene or nylon resin or paper with or without a layer of another material or even paper coated with resin. When the sack is implemented as two resin layers, the inner layer and outer layer should preferably be formed of polyethylene or similar resin and nylon resin or similar resin, respectively. This kind of sack does not easily break when subjected to, e.g., pressure.

Further, a flexible material may be provided with an aluminum layer by vapor deposition or may contain an antistatic agent to cope with static electricity.

While the flexible material may have any desired thickness, the thickness should preferably be between about 20 μm and about 200 μm, more preferably between about 80 μm and about 150 μm. An excessively thick flexible material would fail to achieve the above advantages derived from flexibility while an excessively thin flexible material would have its portion packed with the toner slackened and would thereby obstruct the delivery of the toner. The soft toner container of the present invention may even be one having a sack and a mouth prepared separately and removably connected together. Again, it is preferable to implement the hermetically closed condition by, e.g., threaded engagement or insertion. For this purpose, at least the opening of the sack should preferably be formed of a relatively thick, flexible material.

The sack is formed with an opening to which the mouth is to be fitted. To produce the sack, a plurality of pieces prepared beforehand to form a preselected shape may be adhered by, e.g., heat sealing. Alternatively, when the flexible material is selected from a group of plastics, a seamless sack may be formed by extrusion molding. It should be noted that the soft toner container of the present invention may even be one whose sack is partly flexible and partly rigid, as stated earlier.

Figures 3, 16:
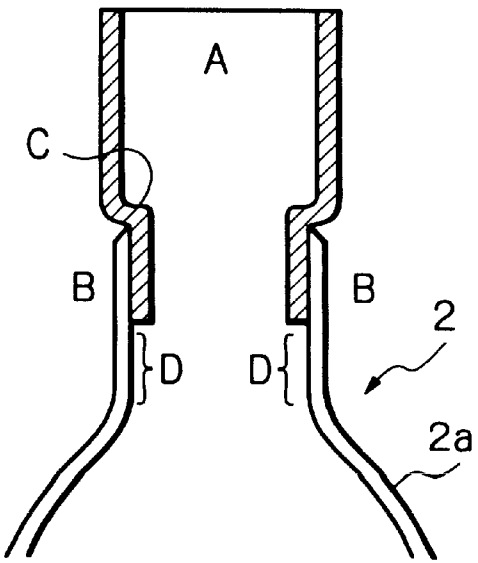
Figures 2, 16:
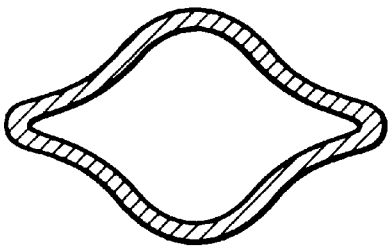
Figures 1, 16:
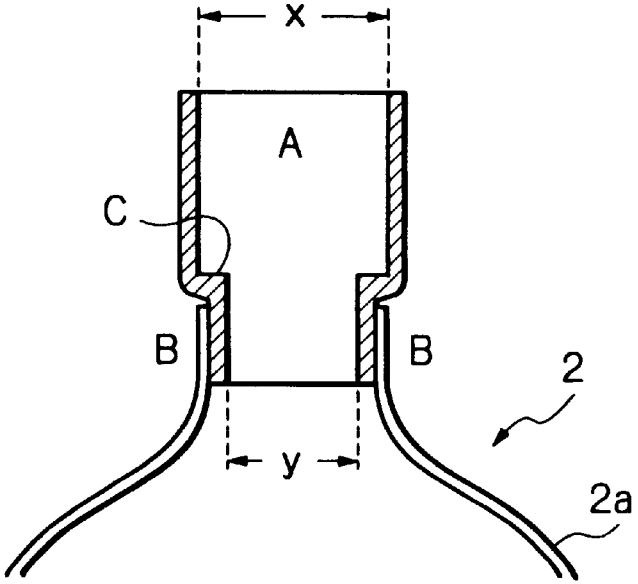

The mouth or toner outlet portion may be formed of polyethylene, polypropylene or similar plastics or metal. While the mouth is relatively rigid, its material should preferably be identical with or at least similar to the material of the sack in order to facilitate joining. The tubular body constituting the mouth is generally made up of a mating portion capable of mating with, e.g., the nozzle and a fitting portion to be fitted in the opening of the sack. Each of the two portions may have a particular inside diameter and a particular structure in accordance with the function assigned thereto. FIG. 16-1 shows a specific configuration of the mouth including a mating portion A and a fitting portion B. As shown, the mating portion A has an inside diameter x greater than the inside diameter y of the fitting portion B. The tight contact enhancing mechanism stated earlier is provided up to the shoulder C. This structure is similarly applicable to the hard toner container.

If desired, the mating portion and fitting portion of the tubular body may be configured to be separable from each other. This configuration allows the elastic member or similar tight contact enhancing mechanism to be easily arranged in the mating portion and allows the separable portions to be individually replaced when damaged. While this can be done with a mating structure or a screw structure, air-tightness is essential when the two portions are connected together.

To fit the fitting portion B of the tubular body to the sack, it is preferable to use, e.g., heat or ultrasonic wave in order to prevent air from leaking from the sack. FIG. 16-2 shows a specific configuration of the fitting portion B for achieving sure fitting. As shown, the fitting portion B has a ship-like cross-section that is superior to the circular cross-section from the above-stated standpoint.

FIG. 16-3 shows a specific device for allowing the air stream to easily deliver the toner from the toner container. As shown, the open portion of the sack 2*a* is fitted on the fitting portion B of the mouth. The open portion of the sack 2*a* includes a portion D having a surface substantially parallel to the surface of the fitting portion B, so that the toner easily gathers at the portion D and can be stably delivered. The portion D has substantially the same length as the fitting portion B although it is open to choice.

The above structures are similarly applicable to the hard toner container.

Figure 17:
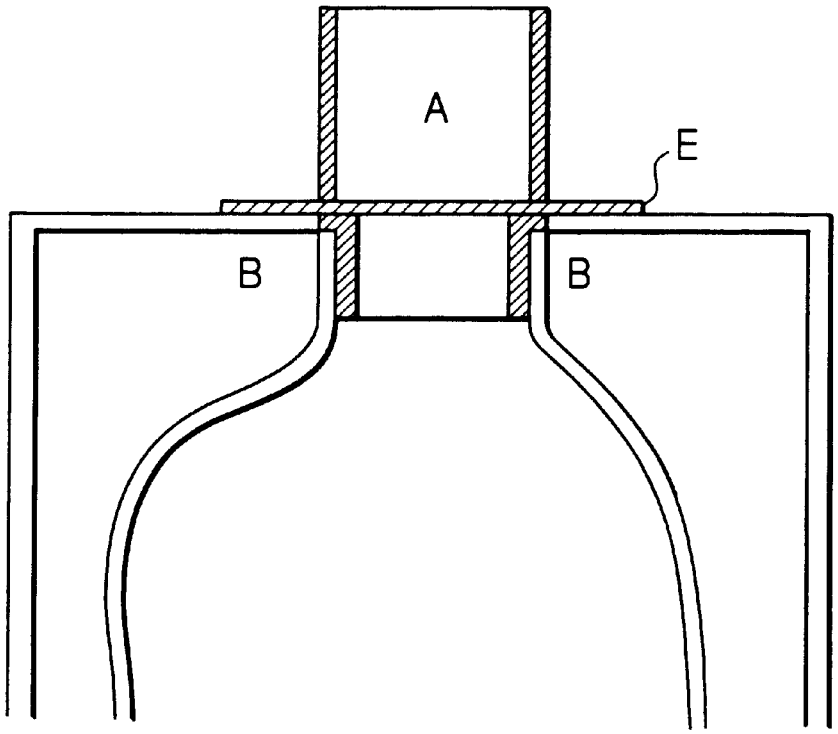
FIG. 17 is a view showing another specific configuration of the mouth.

As shown in FIG. 17, a flange E may radially extend out from the position of the tubular body between the mating portion and the fitting portion substantially perpendicularly to the tubular body. The flange E may be hanged on a preselected portion F of, e.g., a paper or plastic box in-order to facilitate storage or transport. In addition, the flange E allows the container to be easily packed with the toner with its mouth facing upward. The flange E may be applied to the hard toner container also.

Figure 18:
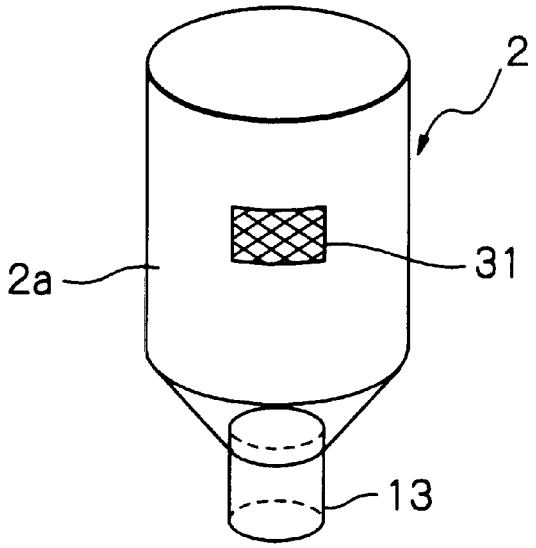
FIG. 18 is a view showing pressure adjusting means provided on a sack forming another part of the toner container.

As shown in FIG. 18, the sack 2A may be provided with a window or similar pressure adjusting means 31 which passes only air therethrough. When the blow system or the combined blow and suction system is used for toner replenishment, excess air flows out of the sack 2*a* via the window 31. This allows air to be almost limitlessly sent into the sack 2*a* and thereby further stabilizes the discharge and replenishment of the toner. Further, the toner is apt to cohere due to the expansion of the toner container 2 when the container 2 is stored over a long time. The window 31 obviates this kind of occurrence also.

Moreover, when the toner container 2 is packed with toner, air inside the container 2 adequately flows out via the window 31. This allows the toner container 2 to be efficiently packed with toner and protects the container 2 from damage in a low temperature environment.

The window 31 or pressure adjusting means may be implemented by the combination of a film formed of porous fluorine-contained resin or similar synthetic resin, paper and a thin metal film. The window 30 may be provided at any desired position of the toner container 2 matching with, e.g., the toner replenishing system and the mouth facing upward or downward. The pressure adjusting means is similarly applicable to the hard toner container.

Various modifications of the toner container in accordance with the present invention will be described hereinafter.

Figures 1, 19:
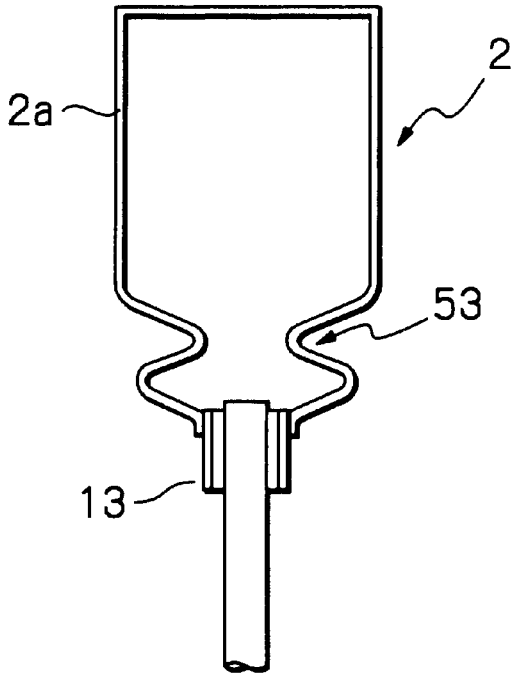
Figures 2, 19:
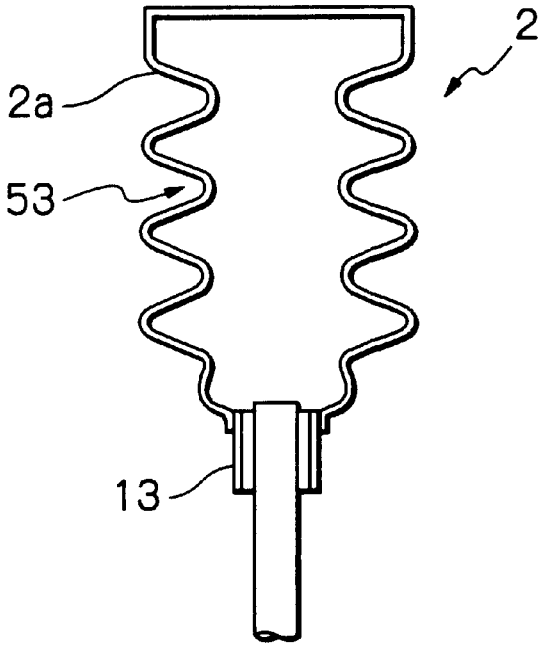

FIG. 19-1 shows a toner container including a squeezed portion adjoining a portion of the sack 2*a* connected to the mouth 13. FIG. 19-2 shows a toner container including a plurality of squeezed portions 53 formed in the side of the sack 2*a*. The or each squeezed portion 53 prevents the weight of the toner above it from being transferred to the mouth 13 and thereby prevents the toner adjoining the mouth 13 from cohering while stopping relatively large masses of toner. Consequently, the toner conduit 12 and toner outlet are prevented from being stopped by the toner.

Figure 20:
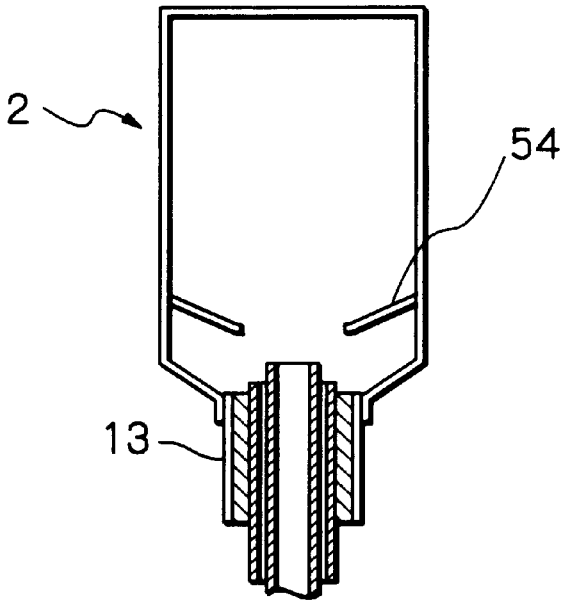
FIG. 20 is a view showing another modification of the toner container.
Figures 3, 21:
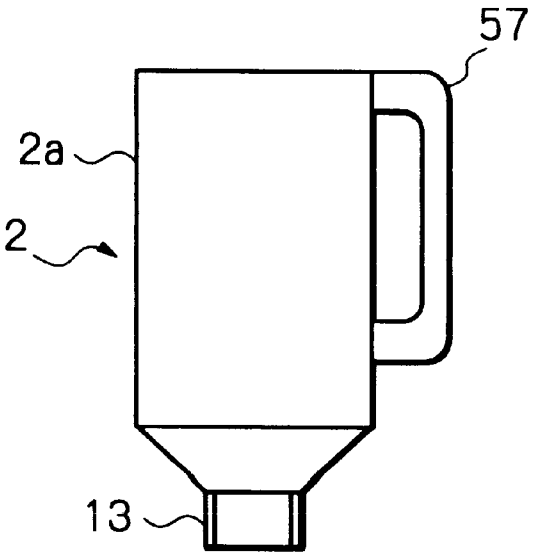
Figures 2, 21:
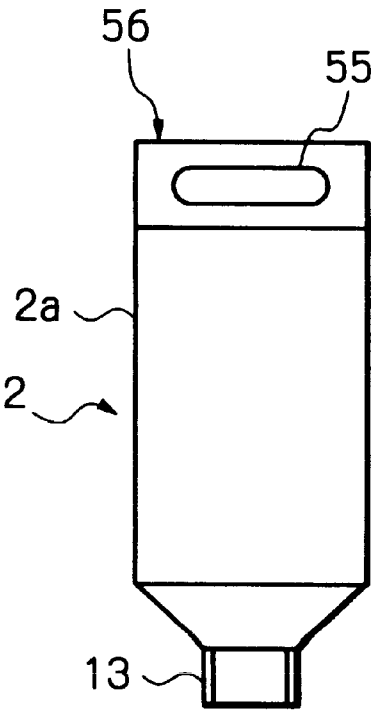
Figures 1, 21:
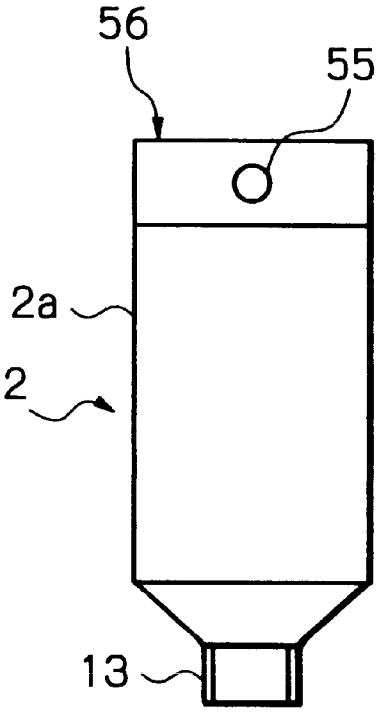

FIG. 20 shows an envelope-like toner container implemented by two flexible materials having substantially the same shape. The two flexible materials are connected by heat sealing except for the end for forming the toner outlet, and then the mouth is fitted in the toner outlet. As shown in FIG. 21-1 or 21-2, a hanging portion 56 formed with a hole 55 may be formed at the bottom of the envelope-like sack 2*a*. Alternatively, as shown in FIG. 21-3, a knob 57 may be formed on the side of the sack 2*a*. The toner container shown in FIG. 21-1 or 21-2 may be mounted to the apparatus body with the hanging portion 56 or the knob 57 held by hand. This prevents the flexible toner container 2 from falling down when the amount of toner remaining therein is short. In addition, the hanging portion 56 or the knob 57 facilitates the conveyance of the toner container 2 packed with toner.

The sack 2*a* of the toner container 2 may be formed of a transparent or substantially transparent material to allow a person to easily determine the amount of toner remaining in the container 2 or the time for replacing the container 12.

Figure 22:
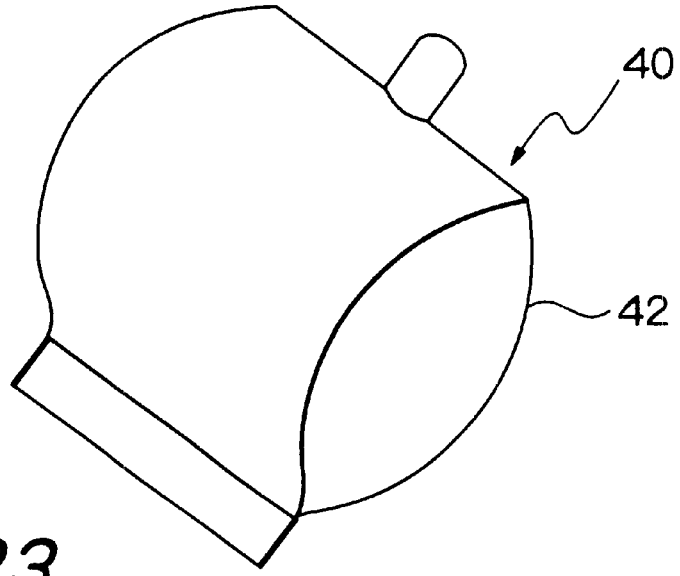
FIG. 22 is a view showing another modification of the toner container.
Figure 23:
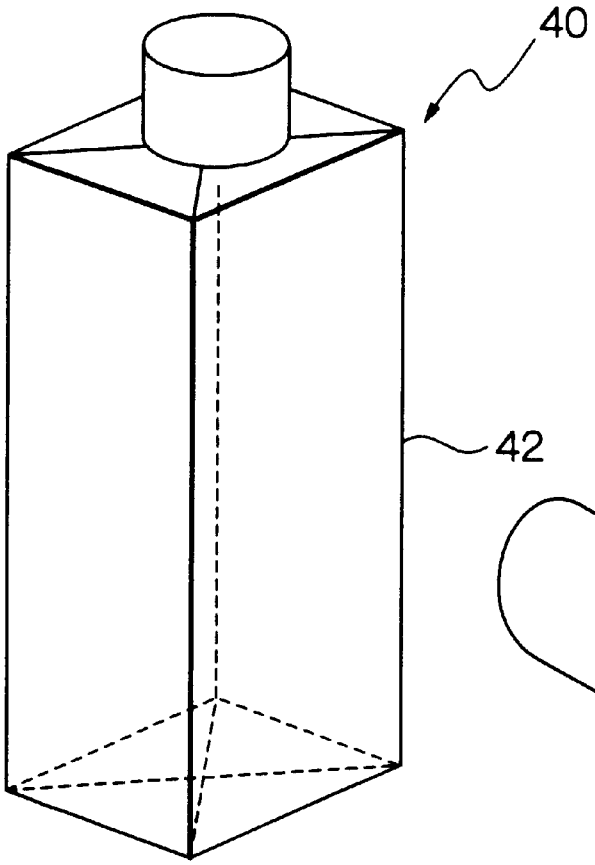
FIG. 23 is a view showing still another modification of the toner container.
Figure 24:
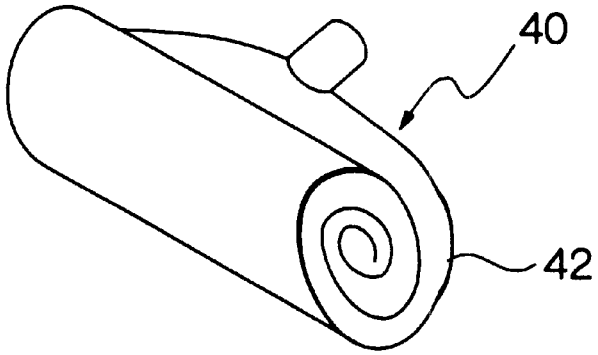
FIG. 24 is a view showing yet another modification of the toner container.

FIG. 22 shows a toner container 40 including a sack 42 formed by the heat sealing of plastic films. FIG. 23 shows a toner container 40 whose sack 42 is formed of paper having some degree of hardness and rigidity like a milk pack. Further, FIG. 24 shows a toner container 40 including a sack 42 constantly biased by, e.g., a spring such that it tends to roll up. When the container shown in FIG. 24 runs out of toner, it rolls up due to its own resiliency and can be easily collected.

Figures 1, 15:
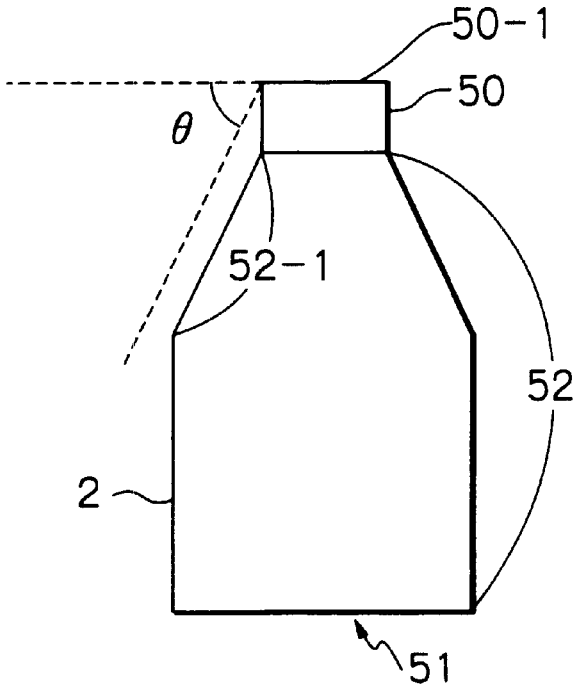
Figures 2, 15:
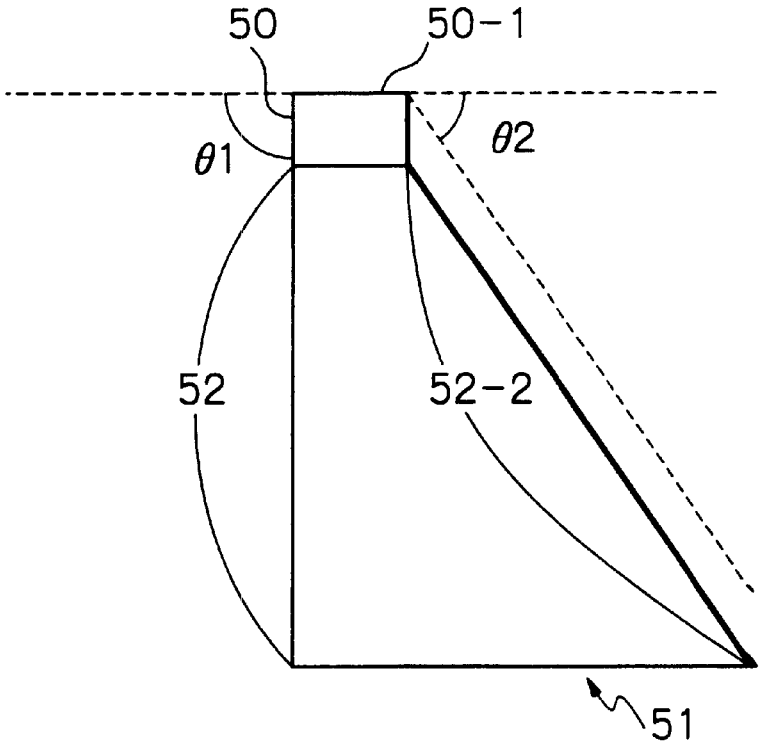
Figures 1, 25:
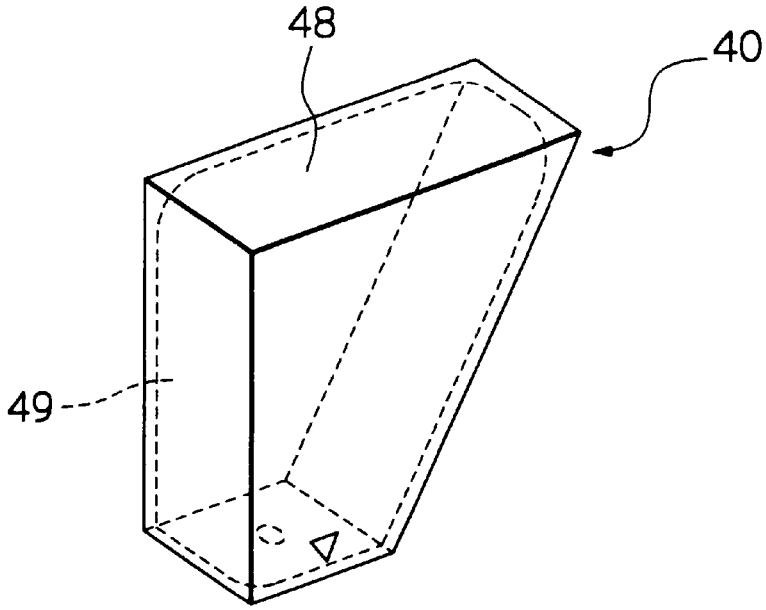
Figures 2, 25:
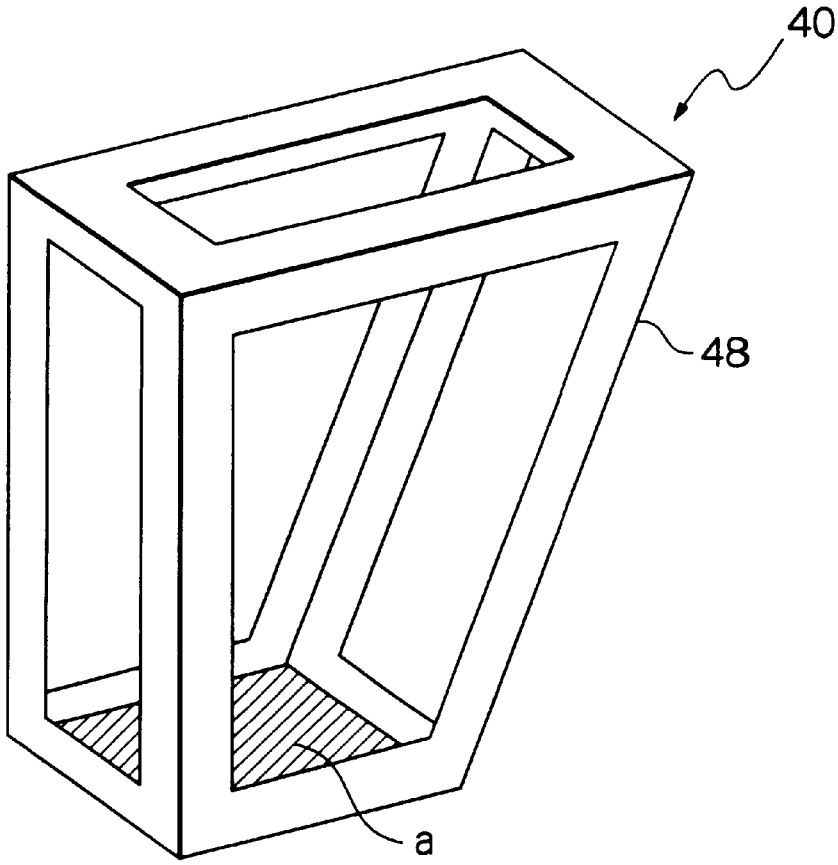

FIGS. 25-1 and 25-2 show a modified toner container 40 similar to the toner container of FIG. 15-2. As shown, the toner container 40 has a sack provided with a rectangular bottom. One or two sides of the sack are inclined by an angle of less than 90 degrees relative to the section of the tubular body. The toner container 40 with this configuration has desirable volume efficiency.

When an image forming apparatus repeats image formation with the soft toner container set therein, the toner container deforms due to the consumption of the toner and is apt to fail to fully discharge the toner. To solve this problem, the present invention uses means for allowing the toner container to preserve its original position as far as possible (position preserving means hereinafter). Specifically, the toner container 40 shown in FIG. 25-1 includes position preserving means 48 surrounding a sack 49. The position preserving means 48 may be formed of relatively hard plastics, paper or a combination thereof and may have any desired shape and structure so long as it can achieve the expected function.

While the position preserving means 48 shown in FIG. 25-1 has a box-like configuration surrounding the sack 49, such a configuration is only illustrative. FIG. 25-2 shows a modification of the position preserving means having six surfaces. As shown, the surfaces of the position preserving means 48 except for the surface, labeled a, for supporting the mouth are holed except for their edge portions.

If desired, the position preserving means may be implemented as a sack filled with air. Also, the position preserving means may be arranged in the apparatus in such a manner as to support the flange shown in FIG. 17, the hanging portion shown in FIG. 21-1 or 21-2 or the knob 57 shown in FIG. 21-3. Further, the position preserving means may be implemented as an adhering member fitted on a suitable position of the sack and adhered to a preselected portion of the apparatus.

The soft toner container supported by the above position preserving means may be transported or stored alone, depending on the structure of the position preserving means.

Generally, a toner container should preferably be packed with as great amount of toner as possible because such a toner container can be efficiently stored or transported and allows the user to obtain a great number of copies with a minimum frequency of replacement. However, should the toner container be packed with an excessive amount of toner, the advantages of the toner replenishing system of the present invention would be difficult to achieve.

We conducted a series of experiments to determine an amount of toner to be effectively packed in a toner container when the toner container was combined with the toner replenishing system. Assume that the packing density of the toner container is produced by dividing the weight (g) of toner packed in a fresh toner container by the capacity ($cm^3$) of the container. The experiments showed that when the packing density was 0.7 $g/cm^3$ or less, toner could be stably replenished from a toner container, whether it be hard or soft, at all times and left in the container only in a minimum amount. It should be noted that the toner replenishing system of the present invention is practicable even with other packing densities, i.e., the packing density of 0.7 $g/cm^3$ should be regarded as the most desirable packing density.

On the other hand, when toner is left at a hot environment over a long period of time, it is apt to form masses. To determine the cause of this occurrence, we conducted two different series of experiments, as follows.

Experiment 1

There were prepared a cylindrical, columnar glass bottle having a diameter of 63.5 mm, a height of 135 mm and a capacity of 250 cc and including a mouth, and three cubic, soft containers implemented by 100 $\mu$m thick flexible sheets consisting of polyethylene and nylon. To produce each soft container, a sack formed by welding the above sheets and a rigid mouth member formed of polyethylene and having a diameter of 14 mm were welded together. Each soft container had a square bottom whose one side was 100 mm long. The bottle and soft containers each were packed, in a normal temperature environment, with 100 g of color toner available from Ricoh Co., Ltd. having a relatively low melting point, i.e., a flow start temperature of about 89°. The bottle and soft containers each were then sealed by caps. Specifically, air inside each soft container was sucked by vacuum of 150 mmHg by use of a nozzle having a length of 60 mm and a diameter of 5 mm. The nozzle was implemented by a 300 mesh filter formed of porous stainless steel. After each soft container had been adjusted to a desired packing density by the suction, it was sealed by a cap. The packing density of the container was determined by dividing the amount of toner (g) by the volume of the container closed by a cap. To determine the volume of the container sealed with a cap, the container was sunk in water, and the resulting change in the level of the surface of the water was measured.

By the above procedure, the glass bottle (sample a) with a packing density of 0.4, one soft container (sample b) with a packing density of 0.4, another soft container (sample c) with a packing density of 0.54 and another soft container (sample d) with a packing density of 0.67 were prepared. How the toner coheres when stored at a temperature of 50° C. was determined with each of the four samples a–d To determine a degree of cohesion, 149 $\mu$m, 74 $\mu$m and 45 $\mu$m metal meshes were stacked. 2 g of toner was put on the 149 m mesh and passed through the mesh stack for 30 seconds to measure the amounts of cohered toner left. The amounts of residual toner each were multiplied by a preselected constant, and the ratio of the sum of the resulting products to the total amount of toner was determined to be the degree of cohesion (%).

Figure 26:
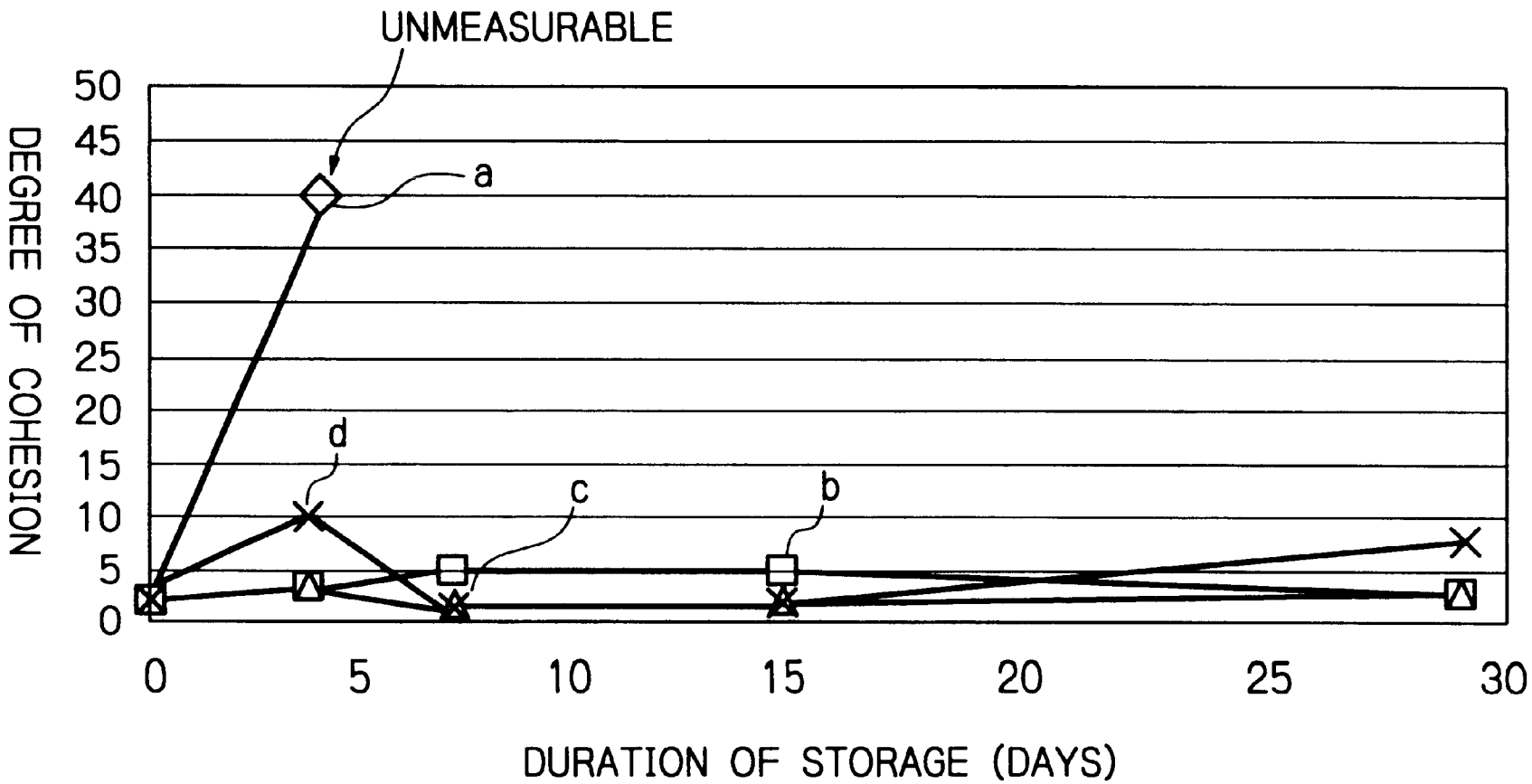
FIG. 26 is a graph showing a relation between the packing density of the,toner container and the degree of cohesion of toner.

FIG. 26 plots the degrees of cohesion determined by the above procedure. As shown, the samples b–d, i.e., soft containers cause the degree of cohesion to change little without regard to the duration of storage. By contrast, the glass bottle or sample a causes its toner to cohere in a short period of time and makes the measurement impossible. The soft containers were found to only slightly expand during storage.

Experiment 2

There were prepared three glass bottles identical with the glass bottle of Experiment 1 and three soft containers identical with the soft containers of Experiment 1. The glass bottles and soft containers each were packed with 100 g of toner to a packing density of 0.4 by the same method as in Experiment 1. Thereafter, all the samples were sealed with caps. Such two kinds of samples were stored at temperatures of 50°, 45° and 40° in order to determine the cohesion states of toner. The cohesion states were measured by penetration as prescribed by JIS (Japanese Industrial Standards) K-2207, i.e., by dropping a needle onto a preselected amount of toner after storage so as to determine the degree of penetration. The unit of penetration is also prescribed by JIS K-2207; a smaller value indicates a lower degree of penetration.

Figure 27:
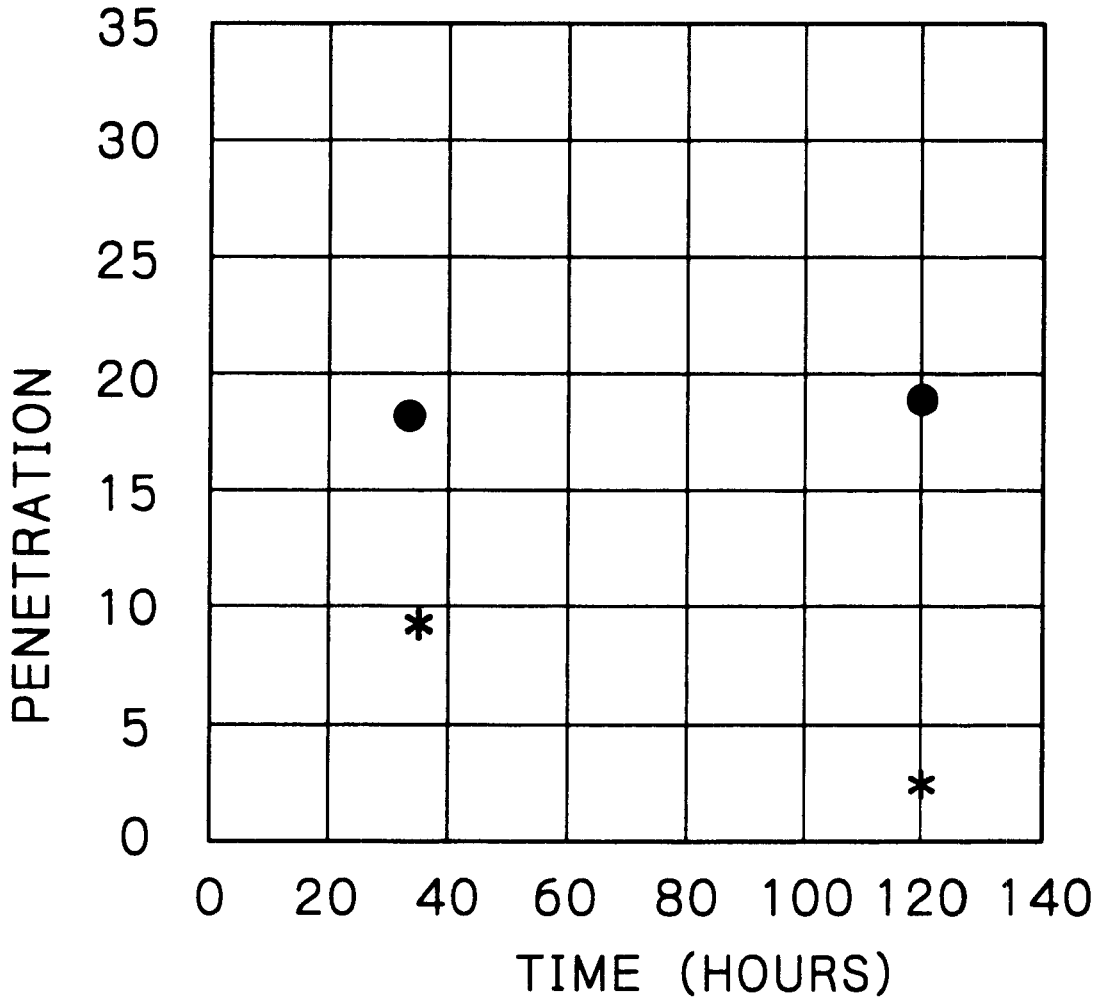
FIG. 27 is a graph showing a relation between the shape of the toner container and the degree of cohesion.

FIG. 27 plots the results of experiments conducted at the temperature of 50° C. In FIG. 27, asterisks and dots correspond to the glass bottles and soft containers, respectively. As for the glass bottles, toner starts cohering on the elapse of 40 hours since the start of the experiment and coheres far more noticeably than toner stored in the soft containers in 120 hours. This tendency was also found at the temperatures of 40° C. and 45° C.

As stated above, when a glass bottle packed with toner and sealed was stored at a high temperature, the toner sequentially coheres with the elapse of time. This is presumably because when air inside the glass bottle expands due to the rise of temperature, pressure inside the bottle rises because the inner periphery of the bottle is implemented by a hard material and cannot absorb the expansion, causing the toner to cohere. This may occur even with a soft toner container when it expands due to temperature elevation to the maximum capacity that cannot be absorbed by flexibility.

In light of the above, the sack of the soft toner container may be provided with the previously stated pressure adjusting means. Apart from this kind of countermeasure, we experimentally determined conditions capable of causing a minimum of toner stored in the soft container to cohere despite temperature elevation. Assume that the soft toner container has a maximum capacity Cmax, that the toner packed in the container occupies a capacity of Ctoner after sealing, and that air occupies a capacity Cair in the sealed container. Then, the above occurrence was successfully obviated when the toner container was packed with the toner in the following condition:

$$(\mathrm{Cmax})-\{(\mathrm{Ctoner})+(\mathrm{Cair})\}\geqq 0.1\times(\mathrm{Cair}) \quad (1)$$

It is to be noted that the maximum capacity of the toner container refers to a capacity which the container has when expanded to its maximum size. The capacity of the toner container can be easily measured in terms of a change in the amount of water in which the container is sunk. The capacity which air occupies refers to the sum of the capacity of air present between toner particles packed in the container and the volume of a space where the toner is absent. This capacity is calculated by subtracting the capacity occupied by the toner from the total capacity of the sealed container. The capacity occupied by the toner is calculated by dividing the weight of the toner by the true specific gravity of the toner.

In the above relation (1), 0.1 may be regarded as a margin of a space against the variation of pressure in the toner container ascribable to temperature elevation. Specifically, the variation of pressure and that of volume ascribable to the variation of temperature in the toner container are derived from the rule of PV/T=constant where P, V and T respectively denote pressure, volume, and absolute temperature. The glass bottles used in the previously described experiments are considered to belong to a system in which volume V is constant. Assume that a hermetically sealed glass bottle has a constant volume, and that the temperature and pressure are respectively 20° C. and P1 at the time of packing and 50° C. and P2 (maximum) at the time of storage. Then, there holds an equation of P2/P1=1.102. Likewise, if the maximum temperature and maximum pressure are 40° C. and P3, then there holds an equation of P3/P1=1.068. That is, temperature elevation causes air inside the toner container to compress the toner; the pressure rises by 10% at50° C. Presumably, therefore, the toner is caused to cohere by both of temperature elevation and pressure elevation ascribable thereto.

On the other hand, the soft toner containers are considered to belong to a system in which pressure P is constant. Pressure inside the toner container effects the toner existing in the container most when temperature is 50° C., as determined by the previously stated experiments. Therefore, if temperature is 20° C. at the time of packing and 50° C. (maximum) at the time of storage, then the toner can be prevented from cohering when pressure in the container remains constant over the temperature difference of 30° C. Specifically, assuming that pressure P inside the toner container is constant, and that temperature and volume are respectively 20° C. and V1 at the time of packing and 50° C. and V2 (maximum) at the time of storage, then there holds an equation of V2/V1=1.102. It follows that if the volume of the container where air is absent is about 1/10 times the volume of air existing in the container, then pressure elevation ascribable to temperature elevation has no influence on the toner and prevents the toner from cohering. Therefore, the value of 0.1 included in the relation (1) refers to 1/10.

Further, it was experimentally determined that the present invention was closely related to the low-temperature fixing ability of toner that is the internal thermal characteristic of toner. For example, assume toner having a flow start temperature at which the toner melts or softens is as low as about 85° C., i.e., toner with a low temperature fixing ability. The degree of cohesion of this kind of toner was found to depend on the kind of a toner container more than the degree of cohesion of other toner and coheres more easily. By contrast, toner having a flow start temperature of 105° C. or above depended on the kind of a toner container little. This difference presumably relates to the fact that toner with a low temperature fixing ability coheres more easily than other toner.

The toner container of the present invention may store any kind of toner applicable to an electrophotographic image forming process, e.g., a one-ingredient type or a two-ingredient type toner which is magnetic or nonmagnetic. The toner consists of, e.g., styrene resin, polyester resin or similar binder resin and a coloring agent with or without the addition of a charge control agent and other additives. As for a one-ingredient type magnetic toner, a ferrite- or magnetite-based magnetic material is additionally added. For full-color image formation, black toner, cyan toner, magenta toner and yellow toner each are stored in a particular toner container. The size of such toner containers and the amount of toner to be stored in each container are suitably adjusted in matching relation to the kind of an image forming process. The toner may be usual black toner or color toner.

A one-ingredient type toner cannot satisfactorily develop a latent image if it is attracted by the developing roller of the developing section more than or less than necessary. This kind of toner therefore should preferably have a true specific gravity ranging from 1.55 to 1.75. A two-ingredient type toner should preferably have a true specific gravity of 1.1 to 1.3.

When toner with the above true specific gravity is packed in the toner container of the present invention, it rapidly sinks in the container with a minimum of air existing therein. This successfully reduces the capacity of the container and therefore the size of the container.

Toner applicable to the toner container of the present invention has a volume mean particle size of 4.0 μm to 12.0 μm, preferably 5.0 μm to 0.9 μm. Particle sizes less than 4.0 μm would bring about problems in image transferring and cleaning steps following development. Particle sizes greater than 12.0 μm would make it difficult to maintain the resolution of an image high. For high definition images, the volume mean particles size of toner should preferably be 9.0 μm or less.

Specific particle size distributions of toner applicable to the present invention are as follows. In toner with a volume mean particle size of 7.5 μm, the number of fine particles of 4.0 μm or below is 18% of the total number of particles while the weight of rough particles of 7.0 μm or above is 1.5% of the total amount. In toner with a volume mean particle size of 9.0 μm, the number of fine particles of 4.0 μm or below is 15% of the total number of particles while the weight of rough particles of 7.0 μm or above is 2.0% of the total weight. The number of particles and weight mean particle size were measured by using Coulter TA-2 available from Coulter.

Figure 28:
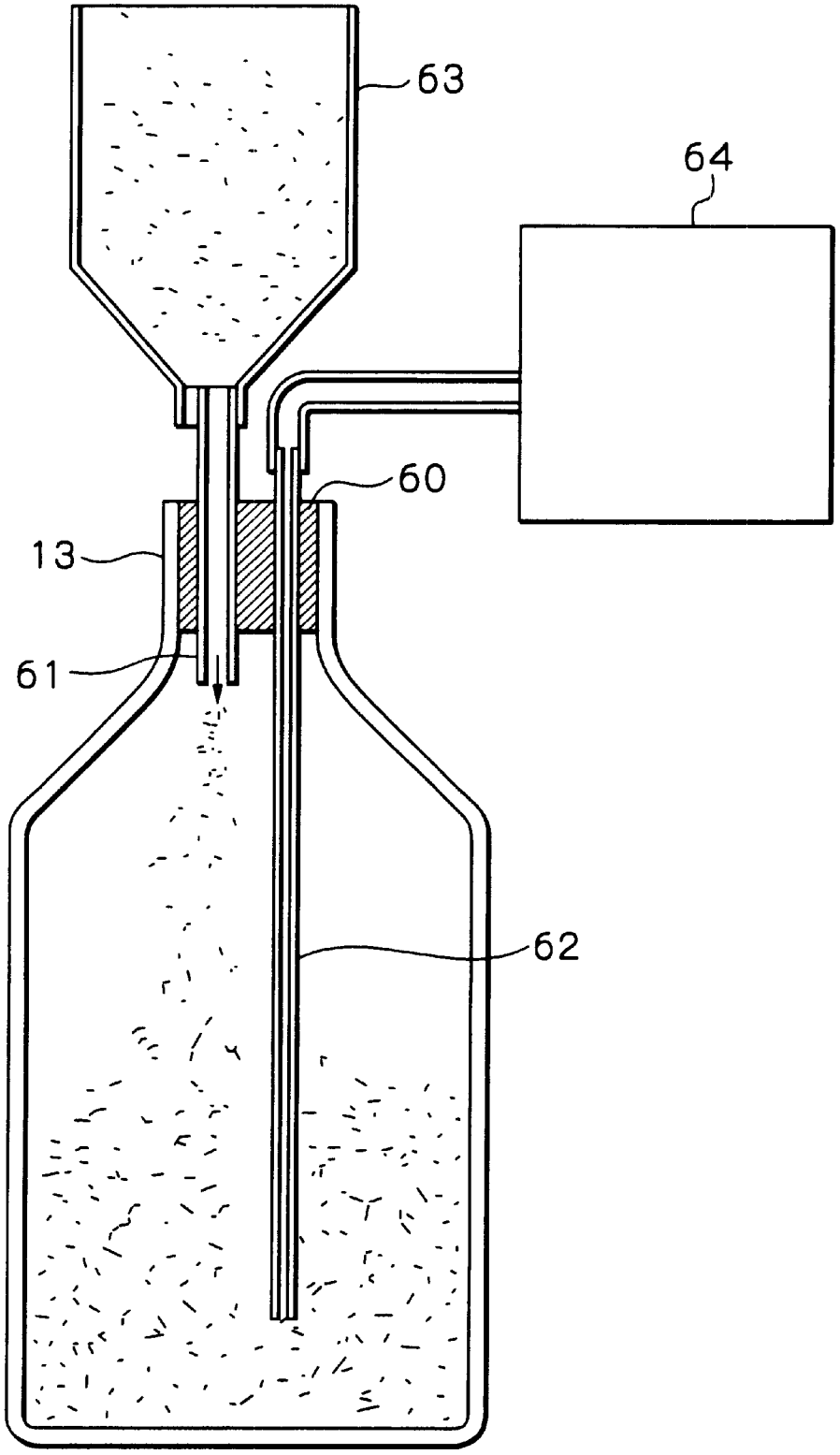
FIG. 28 is a view showing a specific method of packing the toner container with toner.

A method of packing the toner container of the present invention with toner will be described hereinafter. The method may basically be any one of conventional methods including one taught in Japanese Patent Laid-Open Publication No. 8-334968 and will be briefly described with reference to FIG. 28. As shown, a toner packing tube 61 and an air suction tube 62 are respectively inserted into two through bores formed in a member 61. The member 61 with the tubes 61 and 62 has been fitted in the mouth 13 of the toner container. Subsequently, a hopper 63 included in a toner packing machine and a suction pump 64 are connected to the tubes 61 and 62, respectively. In this condition, the suction pump 64 is operated to pack the toner container with toner. By sucking air out of the container with the suction pump 64, it is possible to stably and densely pack the container with toner without any space occurring in the container.

In the case of the hard toner container, the toner from the hopper 63 drops into air existing in the container. As a result, air exists between toner particles and prevents them from rapidly sinking. This is apt to increase the packing time and contaminate the toner. The soft toner container is free from this problem because it is substantially evacuated before packing. Moreover, even when the toner dropping from the hopper 63 stops the inlet of the soft toner container, pressure can be applied to the toner via the flexible sack so as to loosen the toner. It follows that while the hard container needs suction at the time of packing, the soft container can be packed with a sufficient amount of toner without any suction. In any case, the toner container packed with the toner is sealed by some method, as stated earlier.

Examples of the present invention will be described hereinafter although they do not limit the present invention at all.

Example 1 pertains to the combination of the blow type toner replenishing system of the present invention and the hard toner container including the mouth provided with the tight contact enhancing mechanism Example 1 proves that when an air pump or air sending means is operated, the resulting stream of air actually delivers toner to a destination, and that when the packing density of the container is 0.7 g/cm$^3$ or less, the amount of residual toner to be left in the container at the end of delivery is particularly small.

Figure 29:
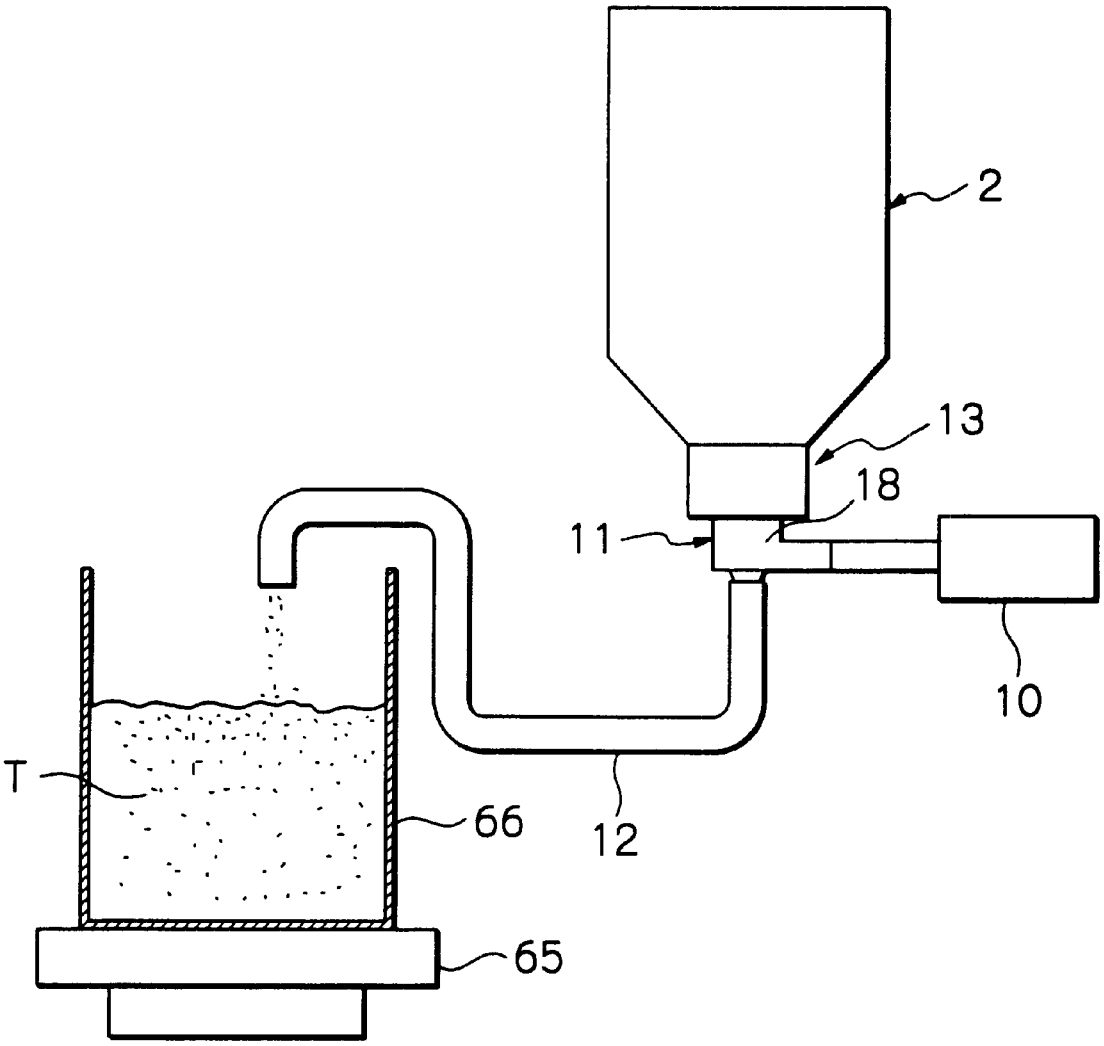
FIG. 29 is a view showing a specific experimental arrangement used in Example 1.

FIG. 29 shows a specific arrangement for executing Example 1. As shown, the arrangement includes the nozzle 11 shown in FIGS. 3-1 and 3-2. The toner outlet portion 16 of the nozzle 11 has an inside diameter of 6 mm and a thickness of 0.5 mm. The air inlet portion 18 is spaced from the toner outlet portion 16 by a gap of 1 mm and has a thickness of 0.5 mm and an outside diameter of 9 mm. The toner conduit 12 is formed of EPDM to be flexibly deformable and provided with an inside diameter of 7 mm. The toner conduit 12 is air-tightly connected to the end of the toner outlet portion 16. The toner conduit 12 is 1,000 mm long and provided with a difference in level or height of 300 mm between its opposite ends. The other end of the toner conduit 12 is fixed in place above a beaker 66 set on an electronic balance 65 (FA-2000 (trade name) available from A & D).

The air pump 10 is air-tightly connected to one end of the air inlet portion 18 by a flexible tube having an inside diameter of 5 mm and formed of EPDM. The air pump 10 was implemented by a diaphragm pump with a flow rate of 1.5 l/min. (SR-01 (trade name) available from Shinmei Electric). A timer, not shown, is connected to the air pump 10 in order to control the duration and interval of suction. The toner container 2 packed with toner is positioned with its mouth facing downward and connected to the nozzle 11. The mouth has an outlet with a diameter of 14 mm and has a tubular body with an inside diameter of 22 mm and a depth of 10 mm above the outlet. Urethane sponge formed with two slits and having a thickness of 10 mm and a diameter of 22 mm is fitted in the mouth and adhered to the inner periphery of the mouth to play the role of the tight contact enhancing means. The two slits intersect each other at the center at an angle of about 90 degrees, and each is 12 mm long.

The nozzle 11 is inserted into the tone container 2 via the sponge such that the hole 15 of the air inlet portion 18 is positioned in the container 2. The toner container 2 has a hard columnar configuration formed of dense polyethylene and having a thickness of 1 mm, an outside diameter of 65 mm and a capacity of 210 cc.

In the above condition, the air pump 10 is operated to deliver the toner from the toner container 2 to the beaker 66 until toner delivery from the container 2 ends. The weight of toner transferred to the beaker 66 was measured by the balance 60 in order to determine the amount of residual toner left in the toner container 2. It is to be noted that the air pump 10 was intermittently driven for 1 second at the intervals of 5 seconds.

More specifically, there were prepared five toner containers 2 respectively having packing densities (g/cm$^3$) of 0.4, 0.5, 0.6, 0.7, 0.8 and 0.9. Toner was introduced into each container 2 by use of a spoon via a funnel inserted into the outlet of the container 2. The amount of toner is adjusted by manually vibrating the bottom of the container 2 with a metal rod.

The above toner consisted of resin particles containing a magnetic material implemented by ion oxide and a polarity control agent, and an additive applied to the outer surfaces of the particles. This kind of toner is extensively used with a laser printer PC-LASER SP-10 available from Ricoh Co., Ltd.

The experiment described with reference to FIG. 29 was conducted with each of the above toner containers 2. The toner containers 2 each were shaken ten times in each of horizontal and vertical directions and then connected to the nozzle 11.

The experimental results proved that even when the toner container 2 and balance 65 were located at remote positions with a difference in level of 300 mm, toner could be delivered from the container 2 to the position above the balance 65 via the flexible toner conduit.

Figure 30:
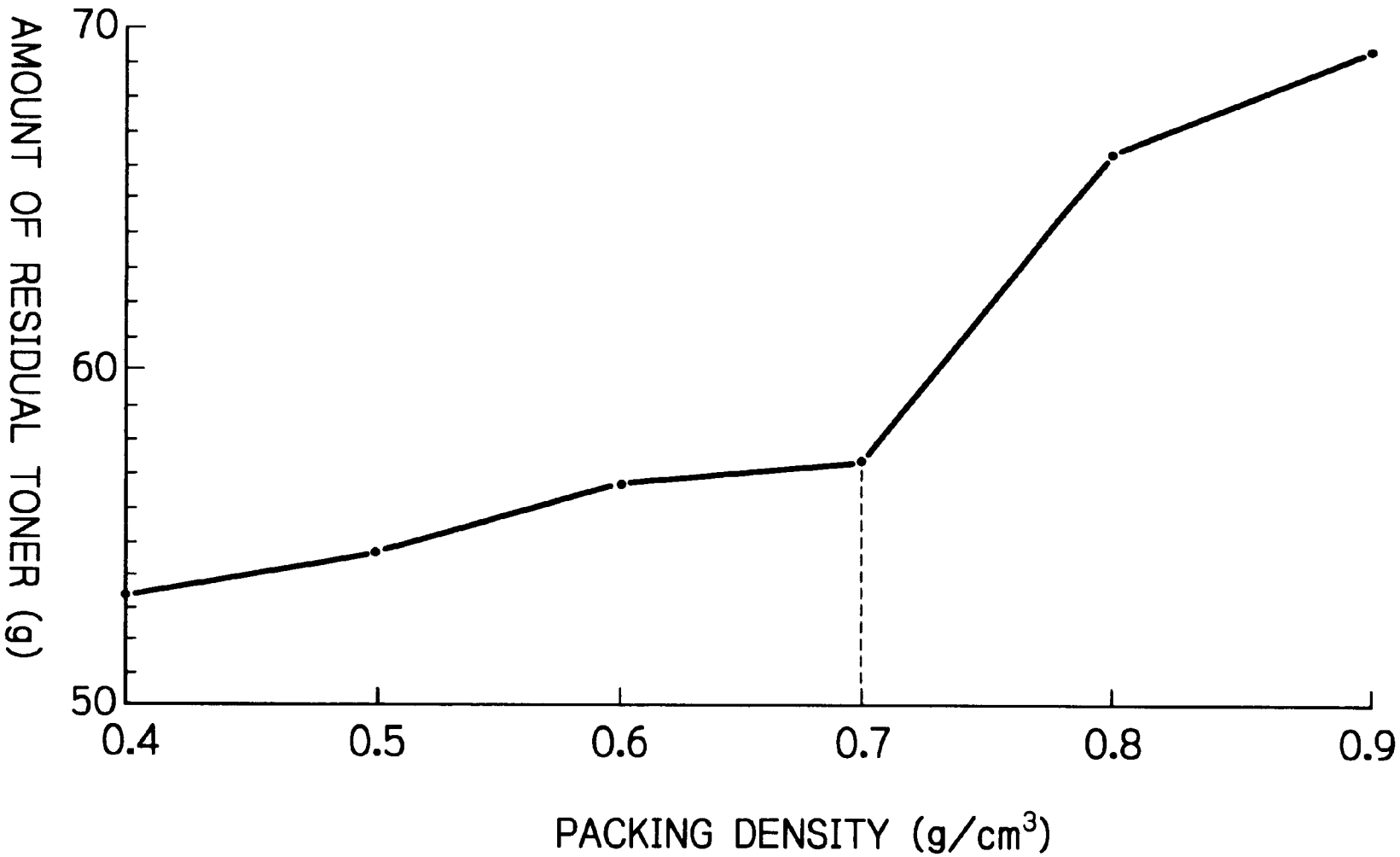
FIG. 30 is a graph showing a relation between the packing density of the toner container and the amount of toner left in the toner container.

As FIG. 30 indicates, when the packing density of the toner container 2 exceeds 0.7 g/cm$^3$, the amount of residual toner left in the toner container 2 at the end of delivery increases. It will therefore be seen that if the packing density is 0.7 g/cm$^3$ or less, the toner can be stably delivered to the developing section 1, FIG. 1, and the amount of residual toner can be minimized or practically reduced to zero. This frees the user from needless expenses. In FIG. 30, the amounts of residual toner appear to be substantial because they are compared with each other. In practice, the amount of residual toner can be further reduced if, e.g., the container 2 is tapered, as stated previously. This was confirmed by experiments.

Figure 31:
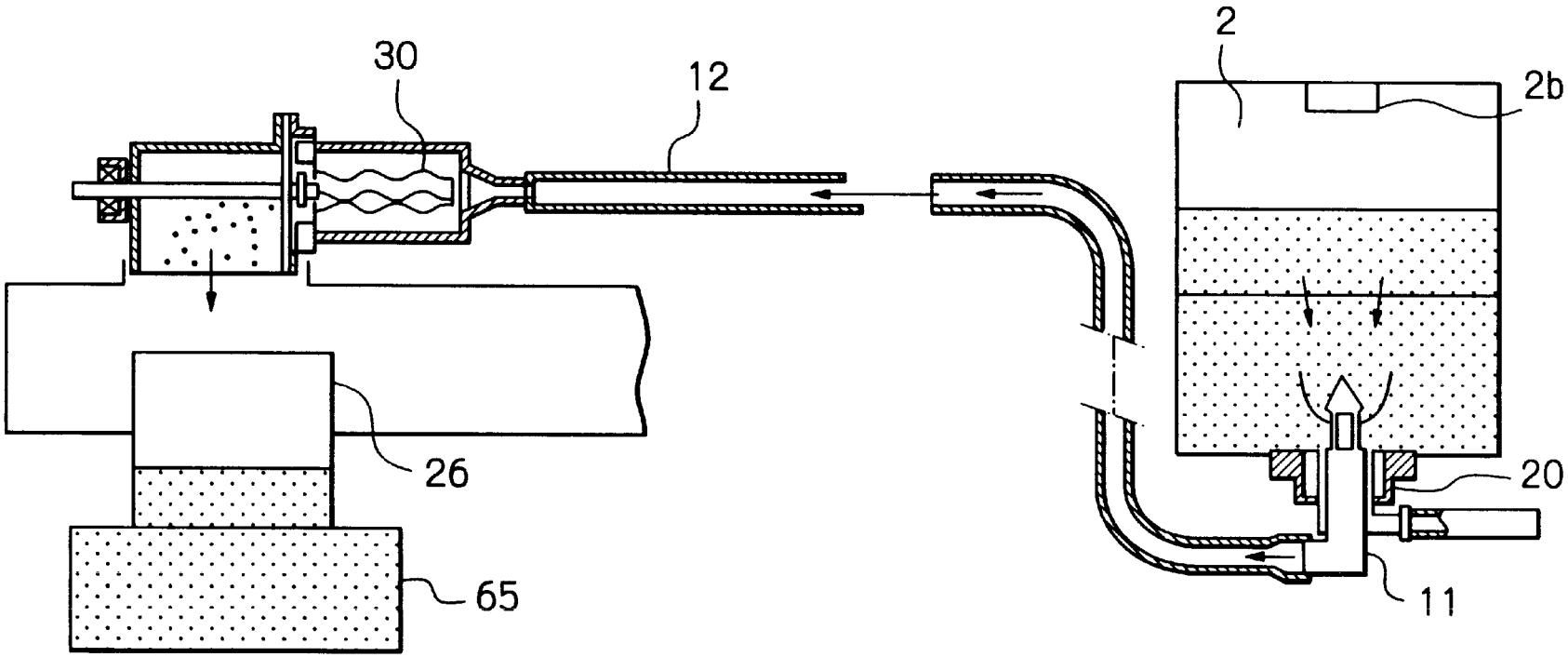
FIG. 31 is a view showing a specific experimental arrangement used in Example 2.

Example 2 is identical in object with Example 1, but uses the combined blow and suction type toner replenishing system including the suction pump. FIG. 31 shows a specific arrangement used to conduct experiments with Example 2. As shown, the suction port of the Mono pump 30, FIG. 8, was connected to the end of one toner conduit of Example 1 while the delivery port of the pump 30 was connected to the other toner conduit. The beaker 66 was positioned below the end of the toner conduit extending form the delivery port of the pump 30. The weight of toner collected in the beaker 66 was measured by the electronic balance 65. The 3 $\mu$m filter 26 having a diameter of 12 mm was adhered to the bottom of the toner container 2 as the pressure adjusting means. As for the rest of the conditions, Example 2 is identical with Example 1.

Figure 32:
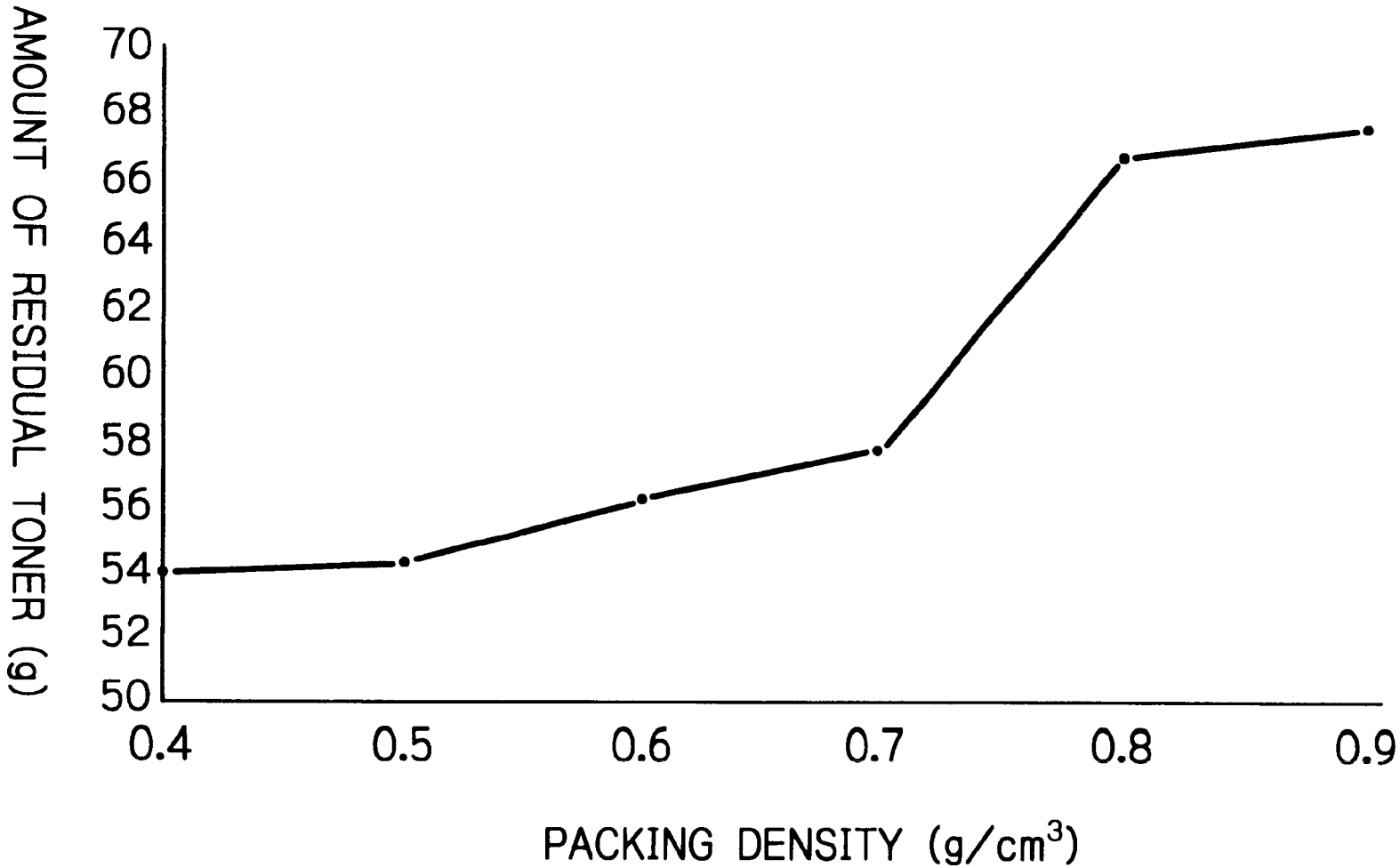
FIG. 32 is a graph showing a relation between the packing density of the toner container and the residual amount of toner.

Specifically, the Mono pump 30 was intermittently driven for 1 second at the intervals of 5 seconds until the toner delivery from the toner container 2 ended. Then, the amount of residual toner left in the toner container 2 was calculated. The experiment showed that the combined blow and suction type toner replenishing system was effective. As FIG. 32 indicates, when the packing density of the toner container 2 decreases below 0.7 g/cm$^3$, the amount of residual toner sharply decreases.

Example 3 is identical with Example 1 except that it used the soft toner container. The soft toner container 2 had a sack implemented by 0.1 mm thick sheets formed of polyethylene and nylon, and a mouth or tubular body formed of polyethylene. The toner outlet of the sack was welded to the outer periphery of the mouth.

Figure 33:
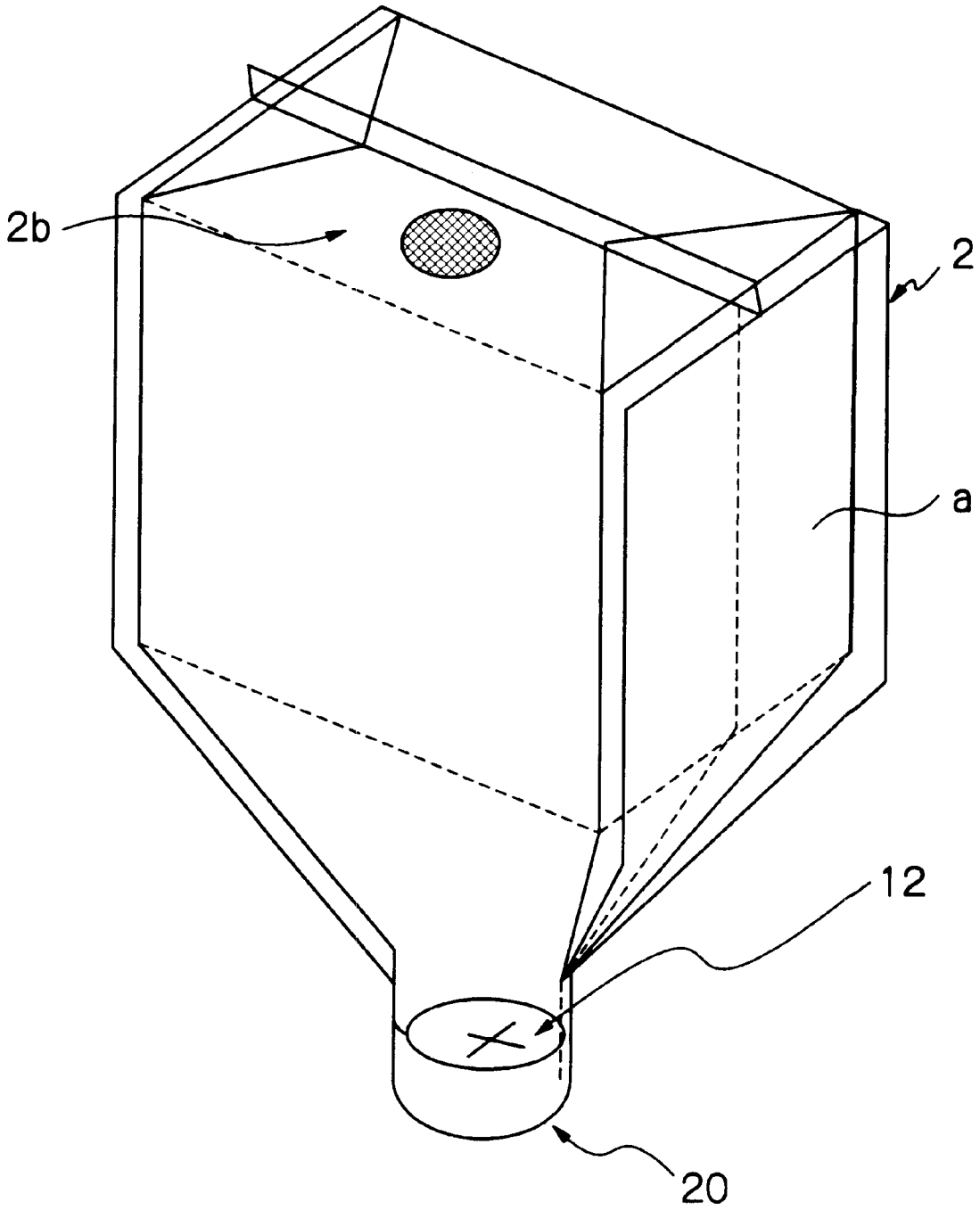
FIG. 33 is a view showing the cubic shape of a toner container used in Examples 3 and 4.

FIG. 33 shows the cubic shape of the above soft toner container 2 As shown, the toner container 2 has a rectangular bottom sized 110 mm longitudinally and 80 mm laterally and has its sides inclined by an angle of about 60 degrees relative to the section of the mouth. The toner container 2 is 130 mm high and provided with a capacity of about 700 cc. The toner container 2 is foldable at the bottom and foldable vertically at the centers of two sides.

More specifically, the sack of the toner container 2 was produced by welding the edges of four sheets such that the container 2 had the expected cubic shape. The fitting portion of the mouth or tubular body formed of polyethylene is formed with a passage having a diameter of 14 mm. The mating portion of the mouth is implemented as a 10 mm long bore having an inside diameter of 22 mm. Urethane sponge (EVERLITE ST (trade name) available from Bridgestone Corp.) with a 25 $\mu$m thick polyethylene terephthalate film adhered thereto is fitted on the wall of the above bore by a two-sided adhesive tape (5000N (trade name) available from Nitto Denko Corp.). The urethane sponge is 10 mm thick and provided with a circular shape having a diameter of 22 mm. Two 12 mm long slits are formed in the urethane sponge and intersect each other at the center at an angle of about 90 degrees.

Six toner containers 2 were respectively packed with toner applicable to a laser printer PC-LASER SP-10 available from Ricoh Co. Ltd. to packing densities of 0.4, 0.5, 0.6, 0.7, 0.8 and 0.9, respectively. The packing density is produced by dividing the amount of toner packed in the toner container 2 by the maximum volume (cc) of the container 2. A high packing density is difficult to achieve with the soft toner container 2 because vibration cannot be easily imparted. In light of this, a 3,000 mesh filter formed of porous stainless steel was fitted on the end of the nozzle 11 that was 60 mm long and had a diameter of 5 mm. The toner container 2 was packed with the toner while being subjected to vacuum of 150 mmHg via the nozzle 11. This was effected with the same arrangement and method as in Example 1.

Figure 34:
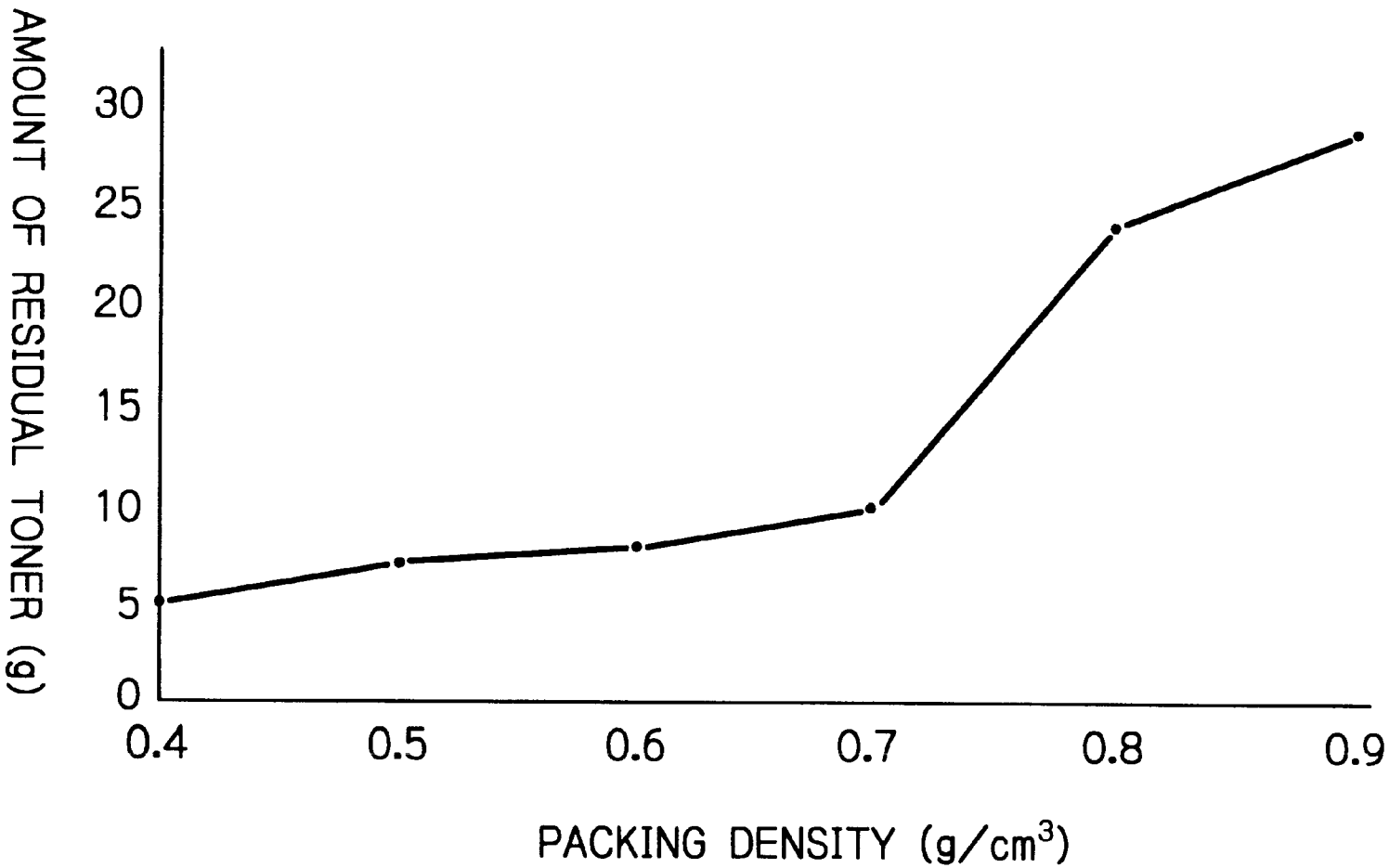
FIG. 34 is a graph showing a relation between the toner container and the residual amount of toner.

The above experiment showed that toner could be delivered even from the soft toner container 2 to a preselected remote position. As FIG. 34 indicates, when the packing density exceeded 0.7, the amount of residual toner to be left in the toner container 2 sharply increased. The toner container 2 sequentially reduced in size toward the mouth was successful to noticeably reduce the amount of residual toner.

Example 4 is concerned with a condition in which the toner is stored in the toner container 2. The toner container 2 used in Example 3 was also used in Example 4. Toner was left in a 20° C. environment for 100 hours. Subsequently, 300 g of the toner was filled in the toner container 2 in a 20° C. environment. Finally, a polyethylene and nylon mixture identical with the material forming the sack of the toner container 2 was welded to the toner outlet of the container 2 in order to seal the toner outlet. Whether or not the toner container 2 satisfies the previously stated relation (1) was determined.

Because Cmax was 700 cc and because the toner had a true specific gravity of 1.2, Ctoner was (300÷1.2)=250 cc. Cair was determined to be 409 cc by the previously stated method. By substituting such values for the relation (1), there was obtained:

$$700-(250+409)=41\geqq 0.1\times 409=40.9$$

The above toner container therefore satisfied the relation (1).

After the toner container 2 packed with the toner had been stored for 10 days in a 50° C. environment, the toner was taken out to see the degree of cohesion. The toner was found to be free from cohesion.

Example 5 proves the effect achievable with the tight contact enhancing mechanism fitted in the mouth of the toner container 2. Two samples [I] and [II] of the mechanism were prepared which were respectively representative of poor contact and tight contact. Specifically, in the sample [I], open cell, ester-based urethane sponge (EVERLITE ST) highly permeable to air was fitted in the mouth. In the sample [II], a 25 $\mu$m thick polyethylene terephthalate film sheet was adhered to the above urethane sponge, and then the sponge was fitted in the mouth. The film does not allow air to pass therethrough. The urethane sponge included in each of the samples [I] and [II] had a diameter of 22 mm and a thickness of 10 mm and was formed with two 12 mm wide slits intersecting each other at the center perpendicularly to each other.

The toner container of Example 3, FIG. 33, was also used in Example 5. The difference is that in Example 5 the 3 $\mu$m filter or pressure adjusting means 26 having a diameter of 12 mm was adhered to the bottom of the toner container 26. The sponge 20 was affixed to the mouth by a two-sided adhesive tape (5000N available from Nitto Denko Corp.). The toner container 20 was packed with 300 g of toner type S Yellow available from Ricoh Co., Ltd. The toner was delivered from the toner container 2 by the combined blow and suction system.

Figure 35:
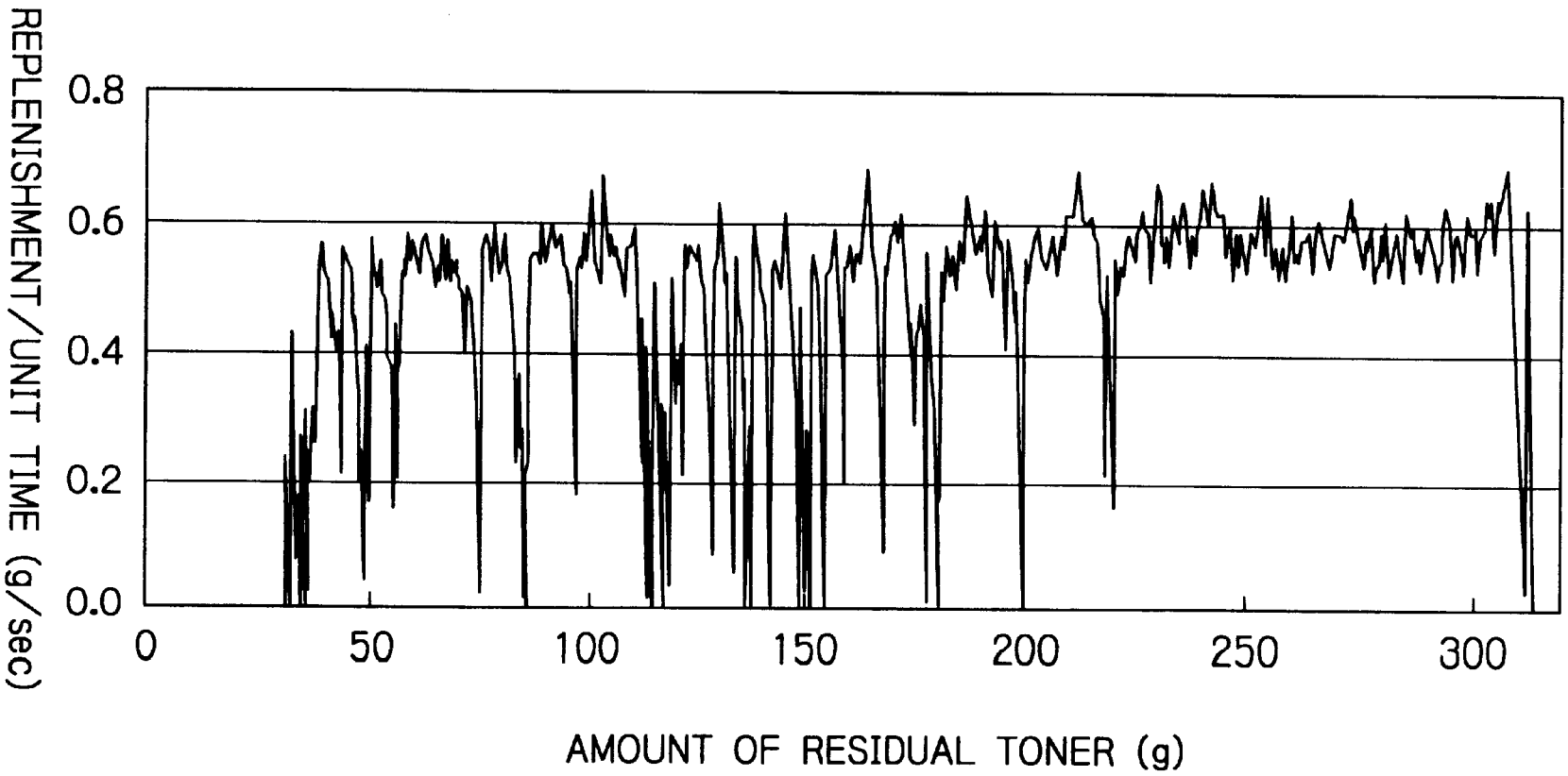
FIG. 35 is a graph showing a relation between the residual amount of toner left in a fist sample used in Example 5 and the amount of replenishment for a unit time.
Figure 36:
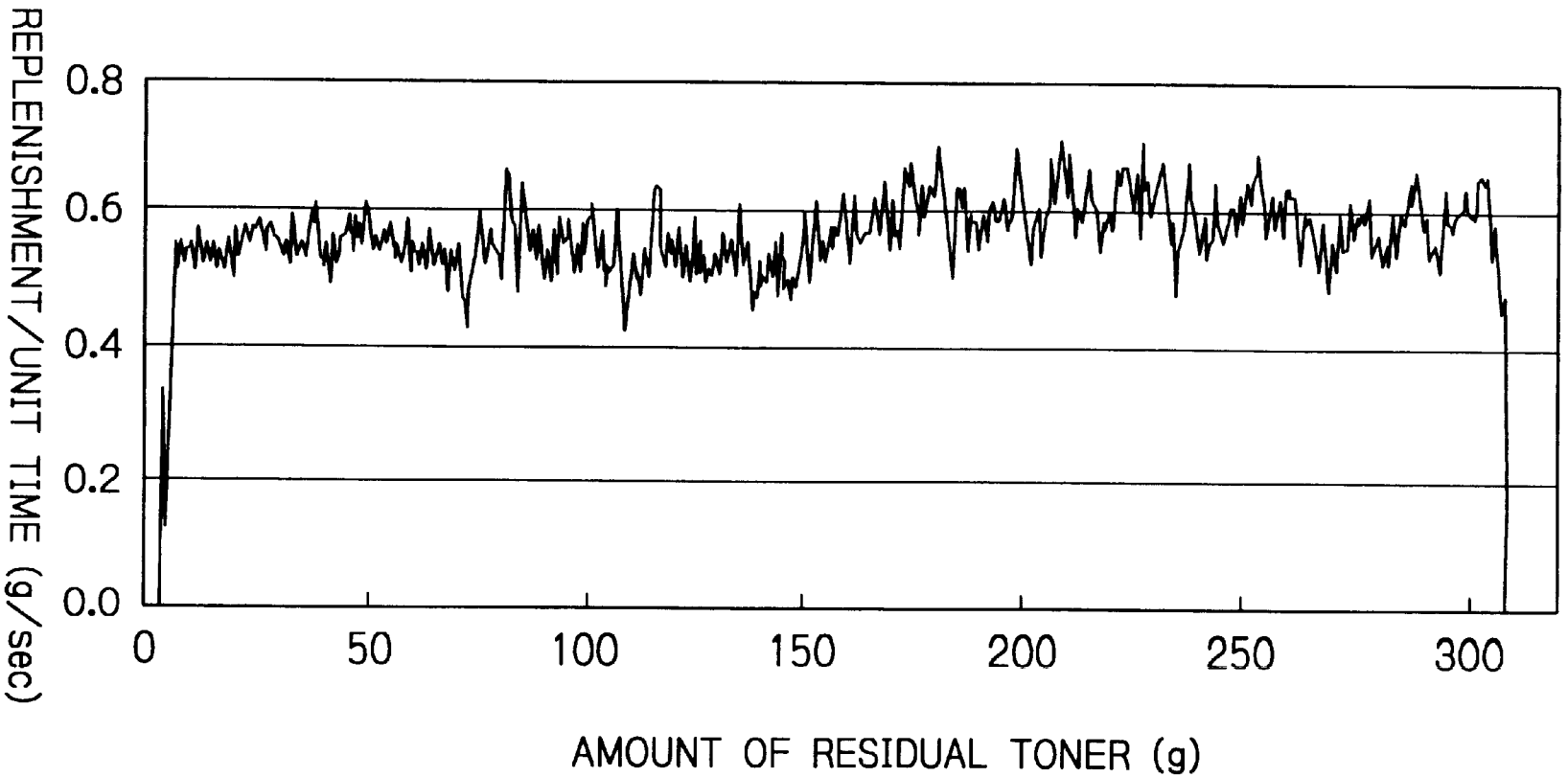
FIG. 36 is a graph showing a relation between the residual amount of toner left in a second sample used in Example 5 and the amount of replenishment for a unit time

For measurement, the arrangement of Example 2 was also used. The nozzle 11 was inserted into the toner container via the slits 12 of the sponge 20 such that the hole 15 of the air inlet portion 18 was positioned in the container 2. Subsequently, air was sent for 1 second while the pump was driven for 1 second. The resulting amount of toner delivered from the toner container 2 was measured by the electronic balance. FIGS. 35 and 36 respectively plot experimental results obtained with the samples [I] and [II]. In FIGS. 35 and 36, the ordinate indicates the amount of toner delivered for a unit drive time of the pump while the abscissa indicates the amount of residual toner left in the toner container. As FIG. 35 indicates, the toner delivery from the sample [I] for a second is sometimes zero and not stable and leaves about 3.5 g of toner therein at the end. On the other hand, as FIG. 36 indicates, the toner is constantly delivered from the sample [II] by about 0.6 g for a second and left little at the end (substantially zero gram).

As FIG. 35 indicates, the toner delivery from the sample [I] noticeably varies and causes a great amount of toner to be left in the toner container. By contrast, as FIG. 36 indicates, the toner delivery from the sample [II] is stable and causes a minimum of toner to be left in the toner container. In the sample [I], the open cell sponge 20 failed to enhance tight contact between the nozzle 11 and the toner container; in fact, when the container was removed from the nozzle 11, contamination ascribable to the toner was found in the portion around the sponge 20. In the sample [II], the sponge 20 with the film prevented air from leaking and thereby enhanced tight contact between the nozzle 11 and the toner container; the portion around the sponge was free from contamination.

In summary, in accordance with the present invention, a toner container and a developing section can be freely laid out in an image forming apparatus, saving a limited space available in the apparatus. Further, toner can be stably replenished to the developing section at all times and is left in the toner container only in a minimum of amount.

Various modifications will become possible for those skilled in the art after receiving the teachings of the present disclosure without departing from the scope thereof.

What is claimed is:

1. A toner container for an electrophotographic image forming apparatus, comprising:

a sack formed of a flexible material;

a toner outlet implemented by a tubular body for discharging toner; and a mating portion for allowing said toner outlet to mate with an elongated member and remain in a mating position with said elongated member, said elongated member extending into the toner container, the mating portion forming a sealing enclosure around the elongated member;

said sack being deformable in accordance with an air pressure to thereby vary a capacity thereof;

wherein assuming that said toner container is packed with toner to a packing density determined by dividing a weight (g) of the toner by a capacity ($cm^3$) of said toner container, said packing density is 0.7 $g/cm^3$or less.

2. A toner container as claimed in claim 1, wherein said toner outlet is sealed.

3. A toner container as claimed in claim 2, wherein said toner outlet is sealed by a flat elastic member sized to cover an inside of a section of said tubular body and formed with slits in direction of thickness, said elastic member being adhered to an inner periphery of said tubular body.

4. A toner container as claimed in claim 2, further comprising a cap for sealing said toner outlet.

5. A toner container as claimed in claim 4, wherein one of a screw and a screw thread is formed in one of an inner periphery and an outer periphery of said tubular body while the other of the screw and the screw thread is formed in said cap, said cap sealing said toner outlet in threaded engagement with said tubular body.

6. A toner container as claimed in claim 2, further comprising a sheet adhered to a section of said tubular body.

7. A toner container as claimed in claim 1, further comprising position preserving means for preserving a position of said sack.

8. A toner container as claimed in claim 2, wherein said position preserving means comprises a box-like member surrounding an entire periphery of said sack.

9. A toner container as claimed in claim 1, wherein the toner is delivered from said toner container to a developing section of said image forming apparatus by an air stream.

10. A toner container for an electrophotographic image forming apparatus, comprising:

a sack formed of a flexible material;

a toner outlet implemented by a tubular body for discharging toner; and a mating portion for allowing said toner outlet to mate with an elongated member and remain in a mating position;

said sack being deformable in accordance with an air pressure to thereby vary a capacity thereof;

wherein assuming that said toner container is packed with toner, that said toner container has a maximum capacity Cmax, and that said toner container packed with the toner and sealed has a capacity Ctoner+Cair where Ctoner and Cair respectively denote a capacity occupied by the toner and a capacity occupied by air, said toner container is packed with the toner to satisfy a relation:

$$(Cmax)-\{(Ctoner)+(Cair)\}\geqq 0.1\times(Cair).$$

11. A toner container as claimed in claim 10, wherein assuming that said toner container is packed with the toner to a packing density determined by dividing a weight (g) of the toner by a capacity ($cm^3$) of said toner container, said packing density is 0.7 $g/cm^3$or less.

12. A toner container as claimed in claim 11, wherein said toner outlet is sealed.

13. A toner container as claimed in claim 12, wherein said toner outlet is sealed by a flat elastic member sized to cover an inside of a section of said tubular body and formed with slits in direction of thickness, said elastic member being adhered to an inner periphery of said tubular body.

14. A toner container as claimed in claim 12, further comprising a cap for sealing said toner outlet.

15. A toner container as claimed in claim 14, wherein one of a screw and a screw thread is formed in one of an inner periphery and an outer periphery of said tubular body while the other of the screw and the screw thread is formed in said cap, said cap sealing said toner outlet in threaded engagement with said tubular body.

16. A toner container as claimed in claim 12, further comprising a sheet adhered to a section of said tubular body.

17. A toner container as claimed in claim 10, further comprising position preserving means for preserving a position of said sack.

18. A toner container as claimed in claim 17, wherein said position preserving means comprises a box-like member surrounding an entire periphery of said sack.

19. A toner container as claimed in claim 10, wherein the toner is delivered from said toner container to a developing section of said image forming apparatus by an air stream.

20. A toner container for an electrophotographic image forming apparatus, comprising:

a sack formed of a flexible material;

a toner outlet implemented by a tubular body for discharging toner;

a mating portion for allowing said toner outlet to mate with an elongated member and remain in a mating position;

and a tight contact enhancing mechanism for enhancing tight contact between said mating portion and the elongated member, the elongated member extending into the toner container, the tight contact enhancing mechanism forming a sealing enclosure around the elongated member;

said sack being packed with toner and deformable in accordance with an air pressure to thereby vary a capacity thereof;

wherein assuming that said toner container is packed with toner to a packing density determined by dividing a weight (g) of the toner by a capacity ($cm^3$) of said toner container, said packing density is 0.7 $g/cm^3$or less.

21. A toner container as claimed in claim 20, wherein said toner outlet is sealed.

22. A toner container as claimed in claim 21, wherein said toner outlet is sealed by a flat elastic member sized to cover an inside of a section of said tubular body and formed with slits in direction of thickness, said elastic member being adhered to an inner periphery of said tubular body.

23. A toner container as claimed in claim 21, further comprising a cap for sealing said toner outlet.

24. A toner container as claimed in claim 23, wherein one of a screw and a screw thread is formed in one of an inner periphery and an outer periphery of said tubular body while the other of the screw and the screw thread is formed in said cap, said cap sealing said toner outlet in threaded engagement with said tubular body.

25. A toner container as claimed in claim 21, further comprising a sheet adhered to the section of said tubular body.

26. A toner container as claimed in claim 20, further comprising position preserving means for preserving a position of said sack.

27. A toner container as claimed in claim 26, wherein said position preserving means comprises a box-like member surrounding an entire periphery of said sack.

28. A toner container as claimed in claim 20, wherein the toner is delivered from said toner container to a developing section of said image forming apparatus by an air stream.

29. A toner container for an electrophotographic image forming apparatus, comprising:

a sack formed of a flexible material;

a toner outlet implemented by a tubular body for discharging toner;

a mating portion for allowing said toner outlet to mate with an elongated member and remain in a mating position; and a tight contact enhancing mechanism for enhancing tight contact between said mating portion and the elongated member;

said sack being packed with toner and deformable in accordance with an air pressure to thereby vary a capacity thereof;

wherein assuming that said toner container is packed with toner, that said toner container has a maximum capacity Cmax, and that said toner container packed with the toner and sealed has a capacity Ctoner+Cair where Ctoner and Cair respectively denote a capacity occupied by the toner and a capacity occupied by air, said toner container is packed with the toner to satisfy a relation:

$$(Cmax)-\{(Ctoner)+(Cair)\}\geqq 0.1\times(Cair).$$

30. A toner container as claimed in claim 29, wherein assuming that said toner container is packed with the toner to a packing density determined by dividing a weight (g) of the toner by a capacity ($cm^3$) of said toner container, said packing density is 0.7 $g/cm^3$or less.

31. A toner container as claimed in claim 29, wherein said toner outlet is sealed.

32. A toner container as claimed in claim 31, wherein said toner outlet is sealed by a flat elastic member sized to cover an inside of a section of said tubular body and formed with slits in direction of thickness, said elastic member being adhered to an inner periphery of said tubular body.

33. A toner container as claimed in claim 31, further comprising a cap for sealing said toner outlet.

34. A toner container as claimed in claim 33, wherein one of a screw and a screw thread is formed in one of an inner periphery and an outer periphery of said tubular body while the other of the screw and the screw thread is formed in said cap, said cap sealing said toner outlet in threaded engagement with said tubular body.

35. A toner container as claimed in claim 31, further comprising a sheet adhered to the section of said tubular body.

36. A toner container as claimed in claim 29, further comprising position preserving means for preserving a position of said sack.

37. A toner container as claimed in claim 36, wherein said position preserving means comprises a box-like member surrounding an entire periphery of said sack.

38. A toner container as claimed in claim 29, wherein the toner is delivered from said toner container to a developing section of said image forming apparatus by an air stream.

39. An electrophotographic image forming method comprising:

setting a toner container packed with toner and including a toner outlet, on an image forming apparatus including a developing section;

setting up a toner delivery passage between said toner container and said developing section, the toner delivery passage including an elongated member that extends into the toner container, the toner outlet of the toner container forming a sealing enclosure with the elongated member; and delivering the toner from said toner container to said developing section via said toner delivery path with an air stream.

40. A method as claimed in claim 39, wherein said toner delivery path is substantially hermetically closed at least during delivery of the toner.

41. A method as claimed in claim 39, wherein said toner delivery passage connects a toner outlet of said toner container and said developing section by elongate toner delivering means.

42. A method as claimed in claim 41, wherein said toner delivering means comprises air stream generating means for generating the air stream.

43. A method as claimed in claim 42, wherein said air stream generating means comprises at least one of air sucking means and air sending means.

44. A method as claimed in claim 39, said toner outlet comprises a tubular body, a tight contact enhancing mechanism being provided on an outer periphery of said tubular body.

45. An image forming apparatus using a toner container including a toner outlet implemented by a tubular body, a mating portion for allowing said toner outlet to mate with an elongated member and an air inlet, said image forming apparatus comprising:

a developing section; and a toner conduit including air flow generating means;

said air inlet of said toner container being connected to one end of said toner conduit while said toner outlet being connected to said developing section, said elongated member extending into the toner container, the mating portion of the toner container forming a sealing enclosure with the elongated member.

46. An apparatus as claimed in claim 45, wherein said air stream generating means comprises air sucking means including a toner suction port connected to a first toner conduit and an air delivery port connected to said developing section either directly or via a second toner conduit.

47. An apparatus as claimed in claim 46, further comprising a tight contact enhancing mechanism provided on an end of said first toner conduit not connected to said toner suction port for enhancing tight contact between said mating portion of said toner container and the elongate matter.

48. An apparatus as claimed in claim 47, wherein said toner container is packed with toner.

49. An apparatus as claimed in claim 48, wherein said tubular body of said toner container and said end of said first toner conduit not connected to said toner suction port are connected to each other.

50. An apparatus as claimed in claim 49, wherein said tight contact enhancing mechanism is provided on said tubular body of said toner container.

* * * * *